US008292731B2

(12) United States Patent
Collette et al.

(10) Patent No.: US 8,292,731 B2
(45) Date of Patent: Oct. 23, 2012

(54) WAGERING GAME WITH COMMUNITY GAME FEATURES

(75) Inventors: Shawn C. Collette, Henderson, NV (US); Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 460 days.

(21) Appl. No.: 12/536,607

(22) Filed: Aug. 6, 2009

(65) Prior Publication Data

US 2011/0034239 A1 Feb. 10, 2011

(51) Int. Cl.
*A63F 9/24* (2006.01)

(52) U.S. Cl. ..... 463/26; 463/16; 463/17; 463/18; 463/19; 463/20; 463/40; 463/41; 463/42

(58) Field of Classification Search ..... 463/16–20, 463/40–42, 26
See application file for complete search history.

(56) References Cited

U.S. PATENT DOCUMENTS

| | | | | |
|---|---|---|---|---|
| 5,941,770 | A | 8/1999 | Miers et al. | |
| 6,196,918 | B1 | 3/2001 | Miers et al. | |
| 6,406,369 | B1 | 6/2002 | Baerlocher et al. | |
| 6,652,378 | B2 * | 11/2003 | Cannon et al. | 463/20 |
| 6,685,560 | B1 | 2/2004 | Hughes | |
| 6,743,096 | B2 | 6/2004 | Allendorf et al. | |
| 6,776,713 | B2 | 8/2004 | Gauselmann | |
| 6,786,824 | B2 * | 9/2004 | Cannon | 463/42 |
| 6,837,793 | B2 | 1/2005 | McClintic | |
| 6,902,478 | B2 | 6/2005 | McClintic | |
| 7,662,040 | B2 * | 2/2010 | Englman et al. | 463/42 |
| 2002/0183105 | A1 | 12/2002 | Cannon et al. | |
| 2003/0119576 | A1 | 6/2003 | McClintic et al. | |
| 2003/0232637 | A1 * | 12/2003 | McDougal | 463/9 |
| 2005/0003886 | A1 | 1/2005 | Englman et al. | |
| 2006/0009283 | A1 | 1/2006 | Englman et al. | |
| 2006/0135243 | A1 | 6/2006 | Englman et al. | |
| 2006/0281526 | A1 * | 12/2006 | Hornik et al. | 463/20 |
| 2006/0287043 | A1 | 12/2006 | Englman et al. | |
| 2008/0070695 | A1 * | 3/2008 | Baerlocher et al. | 463/42 |
| 2008/0113765 | A1 * | 5/2008 | DeWaal | 463/25 |
| 2009/0042641 | A1 | 2/2009 | Anderson et al. | |
| 2009/0124363 | A1 * | 5/2009 | Baerlocher et al. | 463/27 |
| 2009/0286590 | A1 * | 11/2009 | Bennett | 463/20 |

(Continued)

FOREIGN PATENT DOCUMENTS

WO 2007030733 A2 3/2007

(Continued)

*Primary Examiner* — Dmitry Suhol
*Assistant Examiner* — David Duffy
(74) *Attorney, Agent, or Firm* — Nixon Peabody LLP

(57) ABSTRACT

A community game having a "winner-takes-all" feature in which at least one eligible proxy winning player of a round of the community game, which is initiated by a triggering event and is played by multiple players at linked gaming terminals, accrues the highest award among the awards accrued by other proxy players of the community game. The winning proxy player must satisfy an eligibility criterion to participate in the community game and to be eligible to receive the winner-takes-all award, which includes all of the awards accrued by the winning eligible proxy player during one or more rounds and at least the other respective awards accrued by the other proxy players during the round(s). These awards can include those accrued by non-eligible proxy players as well, who are awarded nothing at the end of the round(s). Non-winning eligible proxy players of the community game are awarded whatever awards they accrued during the round(s).

27 Claims, 13 Drawing Sheets

U.S. PATENT DOCUMENTS

| | | | | |
|---|---|---|---|---|
| 2010/0004057 | A1* | 1/2010 | Acres | 463/26 |
| 2010/0203958 | A1* | 8/2010 | Jackson | 463/27 |
| 2010/0304825 | A1* | 12/2010 | Davis et al. | 463/17 |
| 2011/0053683 | A1* | 3/2011 | Aoki et al. | 463/26 |

FOREIGN PATENT DOCUMENTS

| | | | |
|---|---|---|---|
| WO | WO 2008/045398 | A2 | 4/2008 |

* cited by examiner

WAGERING GAME WITH COMMUNITY GAME FEATURES

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering games, and methods for playing wagering games, and more particularly, to a wagering game with community game features.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

One popular type of game is a community game in which multiple eligible players compete for awards. Existing community games do not offer a winner-takes-all feature in which a winning eligible player is awarded awards accrued by other players during the community game.

SUMMARY OF THE INVENTION

According to one an of the present disclosure, a method of conducting a community game in which a plurality of proxy players compete to accrue awards via play of the community game, includes: conducting wagering games at respective ones of a plurality of linked gaming terminals networked together via a network, the community game including at least one round of play during which a winner of the round is identified; in response to an occurrence of a triggering event, using a controller to conduct the community game and cause the community game to be displayed on a display, each of a plurality of eligible proxy players of the community game which satisfy an eligibility criterion to participate in the community game can compete to accrue awards via play of one or more rounds of the community game; during a round of the community game, at least some of the eligible proxy players of the community game accruing respective awards; at the end of the round, responsive to at least a winning one of the eligible proxy players accruing the highest award among the respective awards accrued by the other proxy players, awarding, to the winning eligible proxy player, the highest award and at least the respective awards accrued by the other eligible proxy players.

The round can end responsive to all of the awards available to be won during the round being accrued by at least the eligible proxy players of the community game. Each of the proxy players can be represented by a computer-simulated avatar associated with one or more human players of the community game. The method can further include: displaying each of the computer-simulated avatars representing each of the proxy players on the display as a corresponding graphic; and causing each of the avatars to appear to interact with respective graphics representing the awards in such a way that a predetermined interaction results in the awards being accrued to the proxy player represented by the corresponding avatar during the round.

At least one of the avatars can be associated with at least two of the plurality of proxy players. The awarding can include, in the event of a tie in which a second winning one of the eligible proxy players also accrues the same highest award as the first winning proxy player, awarding to each of the two winning eligible proxy players the highest award and at least the respective awards accrued by the other eligible proxy players during the round.

The method can further include accruing an award during the round to at least one non-eligible proxy player which did not satisfy the eligibility criterion to participate in the community game, the award awarded to the winning eligible proxy player can further include the award accrued by the non-eligible proxy player, and the non-eligible proxy player is not awarded the award accrued during the round. The method can still further include: accruing an award during the round to at least one non-eligible proxy player who did not satisfy the eligibility criterion to participate in the community game; responsive to the non-eligible proxy player accruing the highest award during the round relative to the respective awards accrued by the other proxy players of the community game, awarding to each of the eligible proxy players only the respective awards accrued by each proxy player during the round; and displaying an indication of the non-eligible proxy player who accrued the highest award the highest award accrued by the non-eligible proxy player, where the non-eligible proxy player is not awarded any of the awards accrued during the round.

The method can further include awarding to each of the non-winning eligible proxy players the respective awards accrued by that non-winning eligible proxy player during the round. Each of the proxy players can be indicative of a corresponding human player. The eligibility criterion can be based on at least the quantity of wagers placed by one of the human players on any of the wagering games during a predetermined time period prior to the occurrence of the triggering event. The eligibility criterion can be based on at least an average wager amount placed by a human player on any of the wagering games during a predetermined time period prior to the occurrence of the triggering event. The triggering event can occur in response to a randomly generated number falling within a range of preselected numbers or during one of the wagering games conducted at a corresponding one of the gaming terminals.

The method can further include awarding to the proxy player of the round who accrued the second highest award among the respective awards accrued by the other proxy players during the round, the second highest award and the at least the respective awards accrued by the other eligible proxy players except for the proxy player who accrued the highest award during the round. A multiplier can be associated with at least one of the proxy players upon the occurrence of the triggering event, and the award of the at least one proxy player during the round can be multiplied by the multiplier.

The proxy players can participate in the community game without requiring any additional wager as a precondition to participating in the community game. The method can further include, responsive to more than one proxy player of the proxy players accruing the same highest award at the end of the round, conducting a tie-breaker round during which a tie-breaker award is awarded to a winning one of the proxy players who accrued the same highest award. The method can still further include awarding to at least one of the non-winning proxy players who accrued the same highest award but did not win the tie-breaker award a second-place award having a predetermined value in addition to the award awarded to the at least one non-winning proxy player during the round. Each of the awards can have a value selected from a range of credits. A first of the awards to be awarded can have a first value selected from the range of credits and a last of the awards to be awarded can have a second value selected from the range of credits. The second value can be greater than the first value, and the value of each of the awards can be based on the value of the highest valued one of the awards.

The round can include one or more free spins by at least the eligible proxy players of the community game, and each of the one or more free spins can result in an award being accrued to the proxy player. The awarding can include awarding to the winning eligible proxy player the awards accrued to the winning eligible proxy player during at least one earlier round prior to the round. The award awarded to the winning eligible proxy player can further include the respective awards accrued by the other eligible proxy players during the at least one earlier round.

Each of the proxy players can be indicative of a corresponding human player, and each of the wagering games can include a game sequence in which the human player provides an input and a wagering game outcome is determined. The conducting the wagering games can include: using a user interface device to accept the player input, and transforming the player input to a corresponding electronic data signal indicative of a wager to play the wagering game; using one or more processors to interpret the wager from the data signal and to cause the recording of a digital representation of the wager in one or more storage devices; using at least one of the processors to initiate the game sequence of the wagering game on the networked gaming terminal; using at least one of the processors to cause at least one display device of the gaming terminal to display a representation of the game sequence; and determining an outcome of the game sequence.

According to another implementation of the present disclosure, one or more computer-readable storage media encoded with instructions for directing a gaming system to perform a method of conducting a community game in which a plurality of proxy players attempt to accrue awards via play of the community game, includes: conducting wagering games at respective ones of a plurality of linked gaming terminals networked together via a network, the community game including at least one round of play during which a winner of the round is identified; in response to an occurrence of the triggering event, using a controller to conduct the community game and cause the community game to be displayed on a display, where each of a plurality of eligible proxy players of the community game who satisfy an eligibility criterion to participate in the community game compete to accrue credits via play of one or more rounds of the community game; during a round of the community game, at least some of the eligible proxy players of the community game accruing respective awards; at the end of the round, responsive to at least a winning one of the eligible proxy players accruing the highest award among the respective awards accrued by the other proxy players during the round, awarding, to the winning eligible proxy player, the highest award and at least the respective awards accrued by the other eligible proxy players during the round.

The computer-readable storage media can be further encoded with instructions for directing the gaming system to perform a method that further includes accruing an award during the round to at least one non-eligible proxy player who did not satisfy the eligibility criterion to participate in the community game. The award awarded to the winning eligible proxy player can include at least the award accrued by the non-eligible proxy player. The non-eligible proxy player is not awarded any awards accrued by the non-eligible proxy player during the round.

The computer-readable storage media can be further encoded with instructions for directing the gaming system to perform a method that further includes: accruing an award during the round to at least one non-eligible proxy player who did not satisfy the eligibility criterion to participate in the community game; responsive to the non-eligible proxy player accruing the highest award during the round, awarding to each of the eligible proxy players the respective awards only accrued by each proxy player during the round; and displaying an indication of the non-eligible proxy player who accrued the highest award the highest award accrued by the non-eligible proxy player, where the non-eligible proxy player is not awarded any awards accrued by the non-eligible proxy player during the round.

The computer-readable storage media can be further encoded with instructions for directing the gaming system to perform a method that further includes awarding to each of the non-winning eligible proxy players the respective awards accrued by that non-winning eligible proxy player during the round. Each of the proxy players can be indicative of a corresponding human player. Each of the proxy players can be represented by a computer-simulated avatar associated with one or more human players.

According to another implementation of the present disclosure, a gaming system for conducting a community game in which a plurality of proxy players attempt to accrue awards via play of the community game, includes: means for conducting wagering games at respective ones of a plurality of linked gaming terminals networked together via a network, the community game including at least one round of play during which a winner of the round is identified; means for conducting the community game and for causing the community game to be displayed on a display in response to an occurrence of the triggering event, where each of a plurality of eligible proxy players of the community game who satisfy an eligibility criterion to participate in the community game compete to accrue awards via play of one or more rounds of the community game; means for accruing awards by at least some of the eligible proxy players of the community game during a round of the community game; means, responsive to at least a winning one of the eligible proxy players accruing the highest award among the respective awards accrued by the other proxy players during the round, for awarding, to the winning eligible proxy player at the end of the round, the highest award and at least the respective awards accrued by the other eligible proxy players during the round.

The gaming system can further include means for accruing an award during the round to at least one non-eligible proxy player who did not satisfy the eligibility criterion to participate in the community game. The award awarded to the winning eligible proxy player can include the award accrued by the non-eligible proxy player. The non-eligible proxy player is not awarded any awards accrued by the non-eligible proxy player during the round.

The gaming system can further include: means for accruing an award during the round to at least one non-eligible proxy player who did not satisfy the eligibility criterion to participate in the community game; means for, responsive to the non-eligible proxy player accruing the highest award during the round, awarding to each of the eligible proxy players the respective awards only accrued by each proxy player during the round; and means for displaying an indication of, to the non-eligible proxy player who accrued the highest award, the highest award, where the non-eligible proxy player is not awarded any awards accrued by the non-eligible proxy player during the round.

The gaming system can further include means for awarding to each of the non-winning eligible proxy players the respective awards accrued by that non-winning eligible proxy player during the round.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
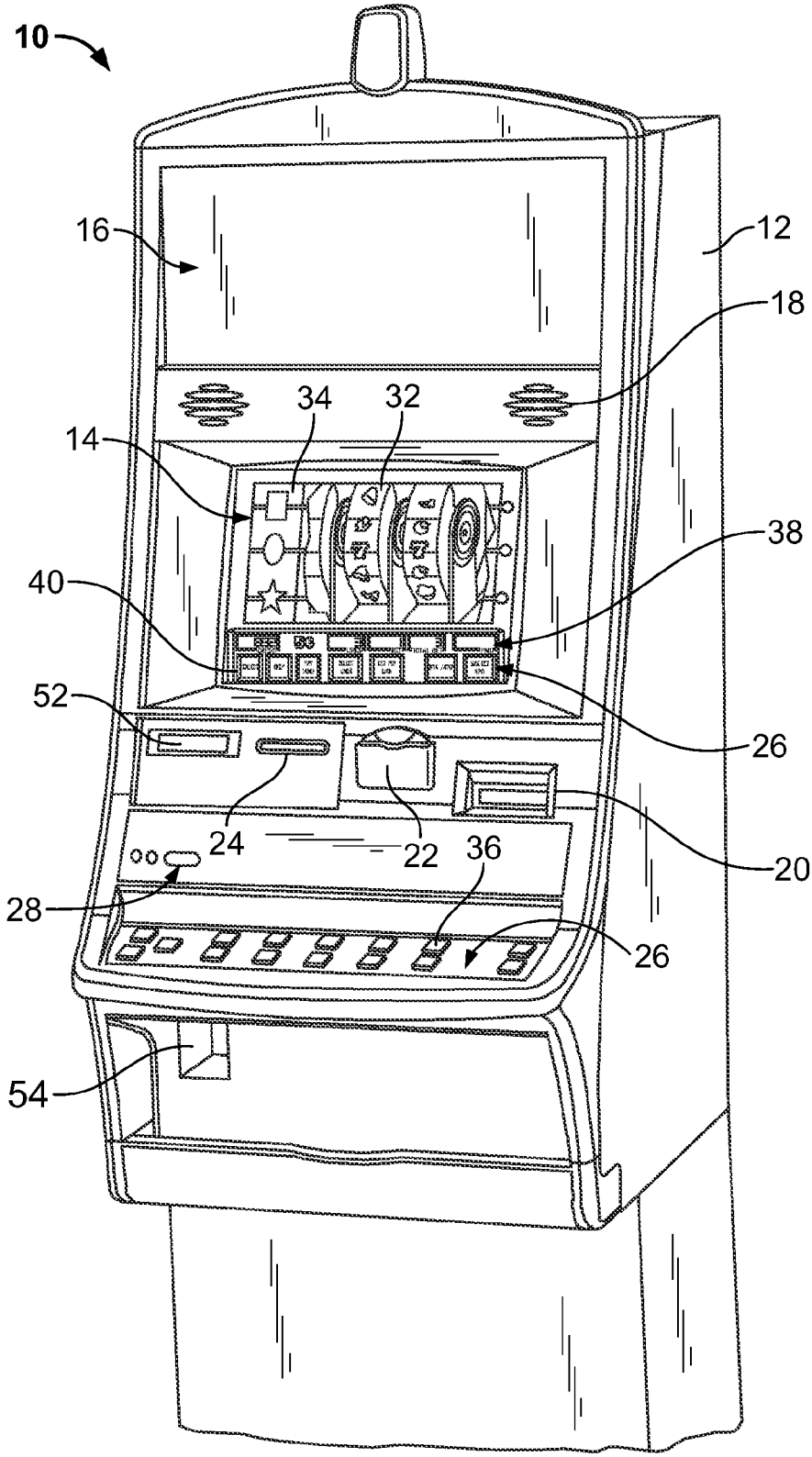
FIG. 1a (Prior Art)
FIG. 1*a* is a perspective view of a free standing gaming machine embodying the present disclosure.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
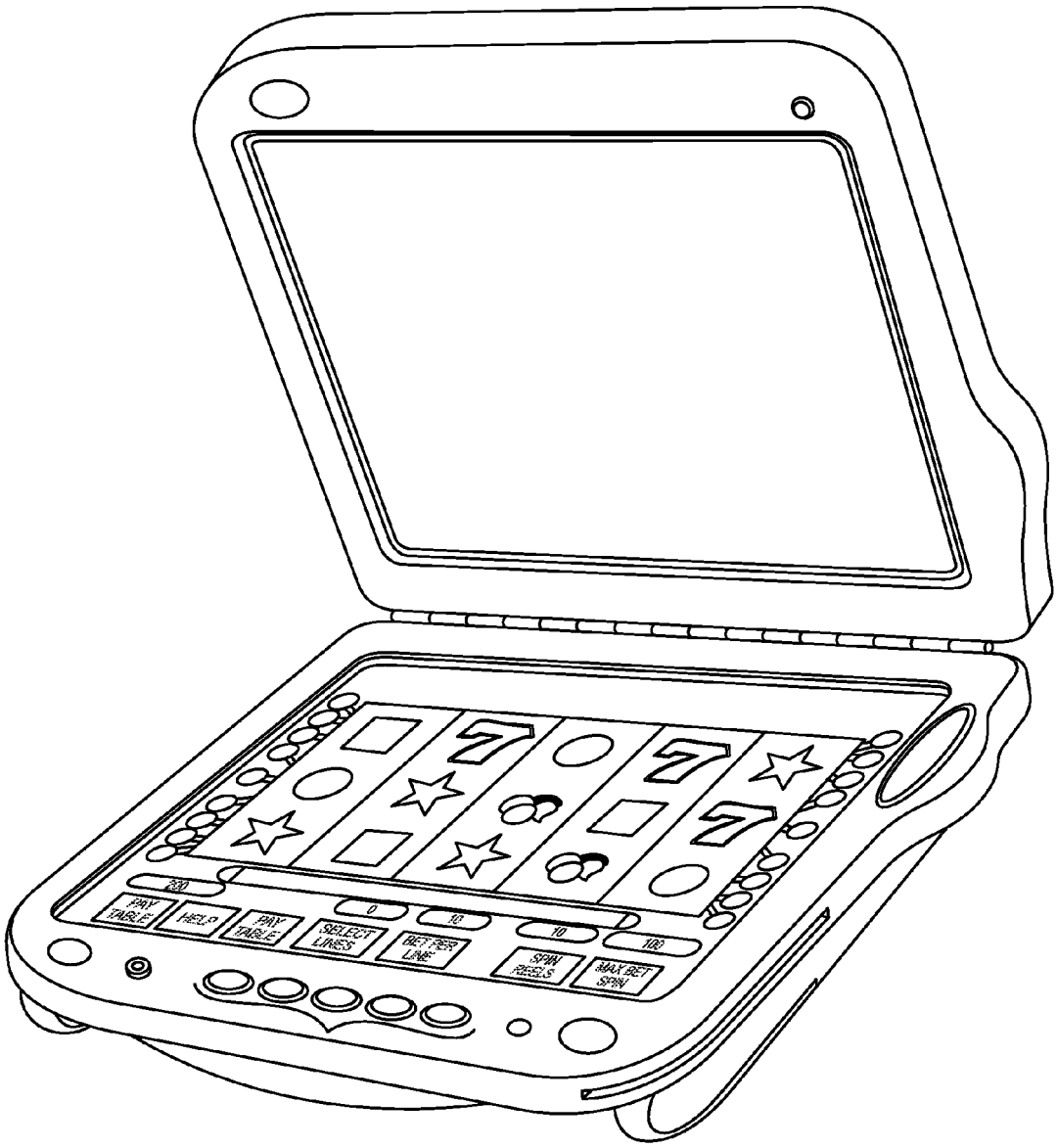
FIG. 1b (Prior Art)
FIG. 1*b* is a perspective view of a handheld gaming machine embodying the present disclosure.

Referring to FIG. 1*a*, there is shown a gaming terminal 10 similar to those used in gaming establishments, such as casinos. With regard to the present invention, the gaming terminal 10 may be any type of gaming terminal and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, craps, etc. It should be understood that although the gaming terminal 10 is shown as a free-standing terminal of the upright type, it may take on a wide variety of other forms such as a free-standing terminal of the slant-top type, a portable or handheld device primarily used for gaming as shown in FIG. 1*b*, a mobile telecommunications device such as a mobile telephone or personal digital assistant (PDA), a counter-top or bar-top gaming terminal, or other personal electronic device such as a portable television, MP3 player, entertainment device, etc.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressives, advertisements, services, premium entertainment, text messaging, emails, alerts or announcements, broadcast information, subscription information, etc. For input devices, the gaming terminal 10 may include a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements may exist and may be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10. The primary display area 14 may include one or more paylines 30 (see FIG. 3) extending along a portion thereof. In the illustrated embodiment, the primary display area 14 comprises a plurality of mechanical reels 32 and a video display 34 such as a transmissive display (or a reflected image arrangement in other embodiments) in front of the mechanical reels 32. If the wagering game conducted via the gaming terminal 10 relies upon the video display 34 only and not the mechanical reels 32, the mechanical reels 32 may be removed from the interior of the terminal and the video display 34 may be of a non-transmissive type. Similarly, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include a plurality of buttons 36 on a button panel and/or a touch screen 38 mounted over the primary display area 14 and/or the secondary display area 16 and having one or more soft touch keys 40. The player-input devices 26 may further comprise technologies that do not rely upon touching the gaming terminal, such as speech-recognition technology, gesture-sensing technology, eye-tracking technology, etc.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed in U.S. Patent Publication No. 2003/0045354 entitled "Portable Data Unit for Communicating With Gaming Machine Over Wireless Link," which is incorporated herein by reference in its entirety. The account may be stored at an external system 46 (see FIG. 2) as more fully disclosed in U.S. Pat. No. 6,280,328 to Holch et al. entitled "Cashless Computerized Video Game System and Method," which is incorporated herein by referenced in its entirety, or directly on the portable medium. To enhance security, the individual carrying the portable medium may be required to enter a secondary independent authenticator (e.g., password, PIN number, biometric, etc.) to access their account.

FIG. 1*b* illustrates a portable or handheld device primarily used to display and/or conduct wagering games. The handheld device may incorporate the same features as the gaming terminal 10 or variations thereof. A more detailed description of a handheld device that may be utilized with the present invention can be found in PCT Patent Application No. PCT/US2007/000792 filed Jan. 26, 2007, entitled "Handheld Device for Wagering Games," which is incorporated herein by reference in its entirety.

Figure 2:
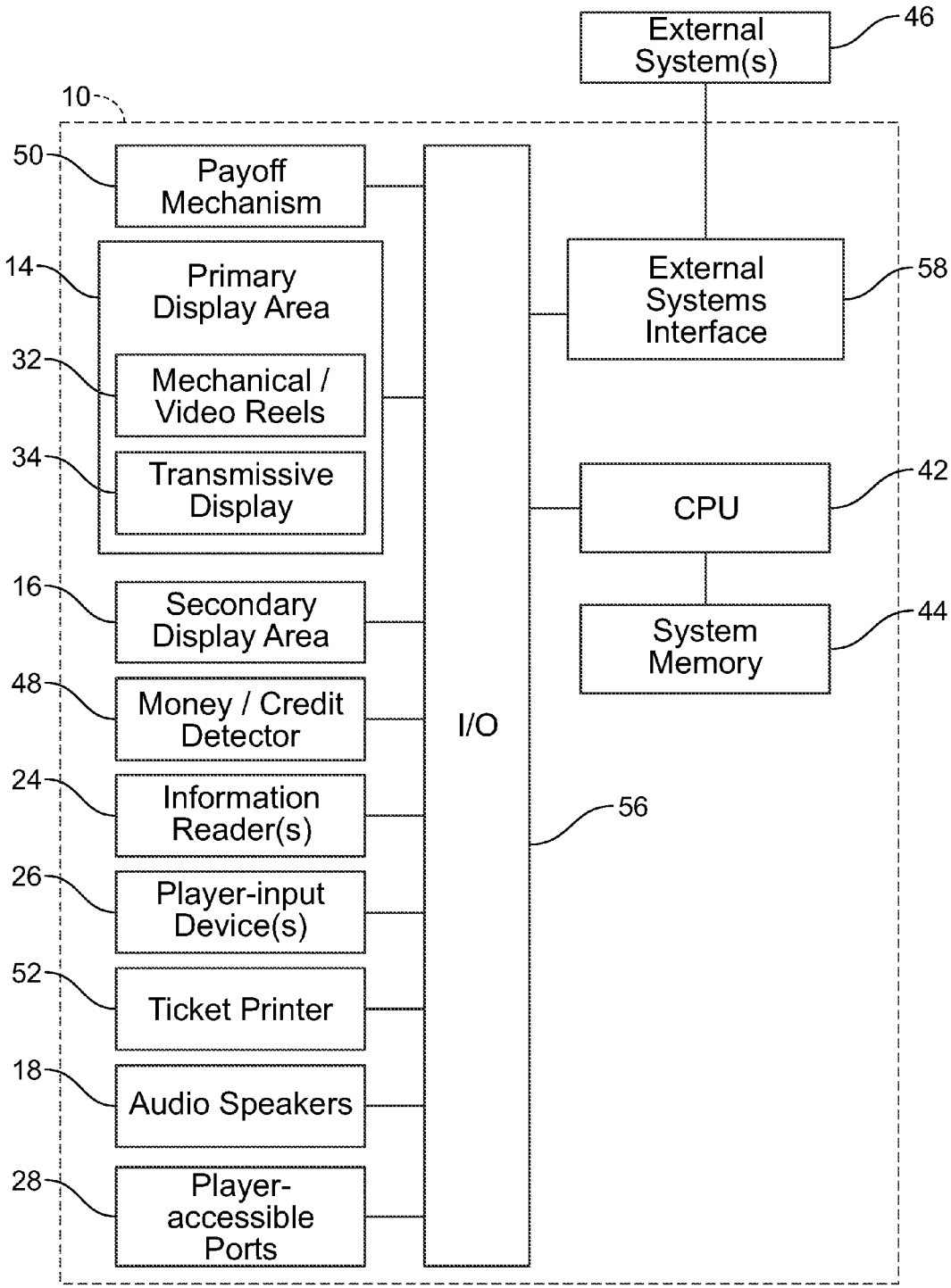
FIG. 2 (Prior Art)
FIG. 2 is a block diagram of a control system suitable for operating the gaming machines of FIGS. 1*a* and 1*b;*

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an INTEL® Pentium processor, INTEL® Core 2 Duo processor, AMD OPTERON™ processor, or ULTRASPARC® processor. To provide gaming functions, the controller 42 executes one or more game programs stored in one or more computer readable storage media in the form of memory 44 or other suitable storage device. The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and multiple program memories. The money/credit detector 48 signals the processor that money and/or credits have been input via a value-input device, such as the bill validator 20, coin acceptor 22, or via other sources, such as a cashless gaming account, etc. These components may be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, and a payoff mechanism 50. The payoff mechanism 50 is operable in response to instructions from the controller 42 to award a payoff to the player in response to certain winning outcomes that might occur in the base game, the bonus game(s), or via an external game or event. The payoff may be provided in the form of money, redeemable points, services or any combination thereof. Such payoff may be associated with a ticket (from a ticket printer 52), portable data unit (e.g., a card), coins, currency bills, accounts, and the like. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface 58, which is connected to the external system 46. The controller 42 communicates with the external system 46 via the external system interface 58 and a communication path (e.g., serial, parallel, IR, RC, 10bT, etc.). The external system 46 may include a gaming network, other gaming terminals, a gaming server, a remote controller, communications hardware, or a variety of other interfaced systems or components.

Controller 42, as used herein, comprises any combination of hardware, software, and/or firmware that may be disposed or resident inside and/or outside of the gaming terminal 10 and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Figure 3:
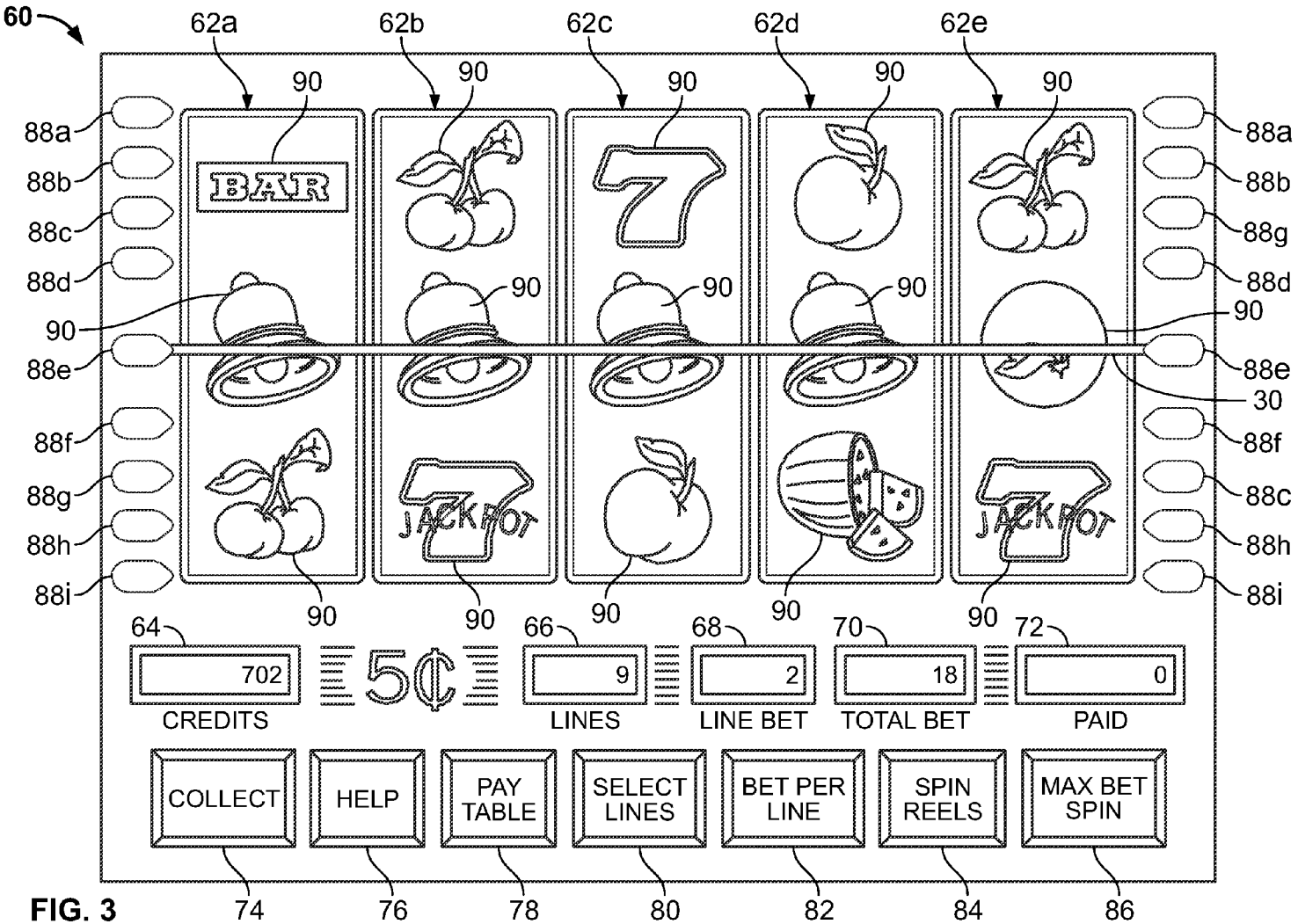
FIG. 3 (Prior Art)
FIG. 3 is a perspective view of a plurality of linked gaming machines and a community display embodying the present disclosure.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The basic-game screen 60 may be displayed on the primary display area 14 or a portion thereof. In FIG. 3, the basic-game screen 60 portrays a plurality of simulated movable reels 62*a-e*. Alternatively or additionally, the basic-game screen 60 may portray a plurality of mechanical reels. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e;* and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

Paylines 30 may extend from one of the payline indicators 88*a-e* on the left side of the basic-game screen 60 to a corresponding one of the payline indicators 88*a-e* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations may be evaluated as line pays or scatter pays. Line pays may be evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e.* While an embodiment with nine paylines is shown, a wagering game with no paylines, a single payline, or any plurality of paylines will also work with the present invention. Additionally, though an embodiment with five reels is shown, a gaming terminal with any plurality of reels may also be used in accordance with the present invention.

Figure 4:
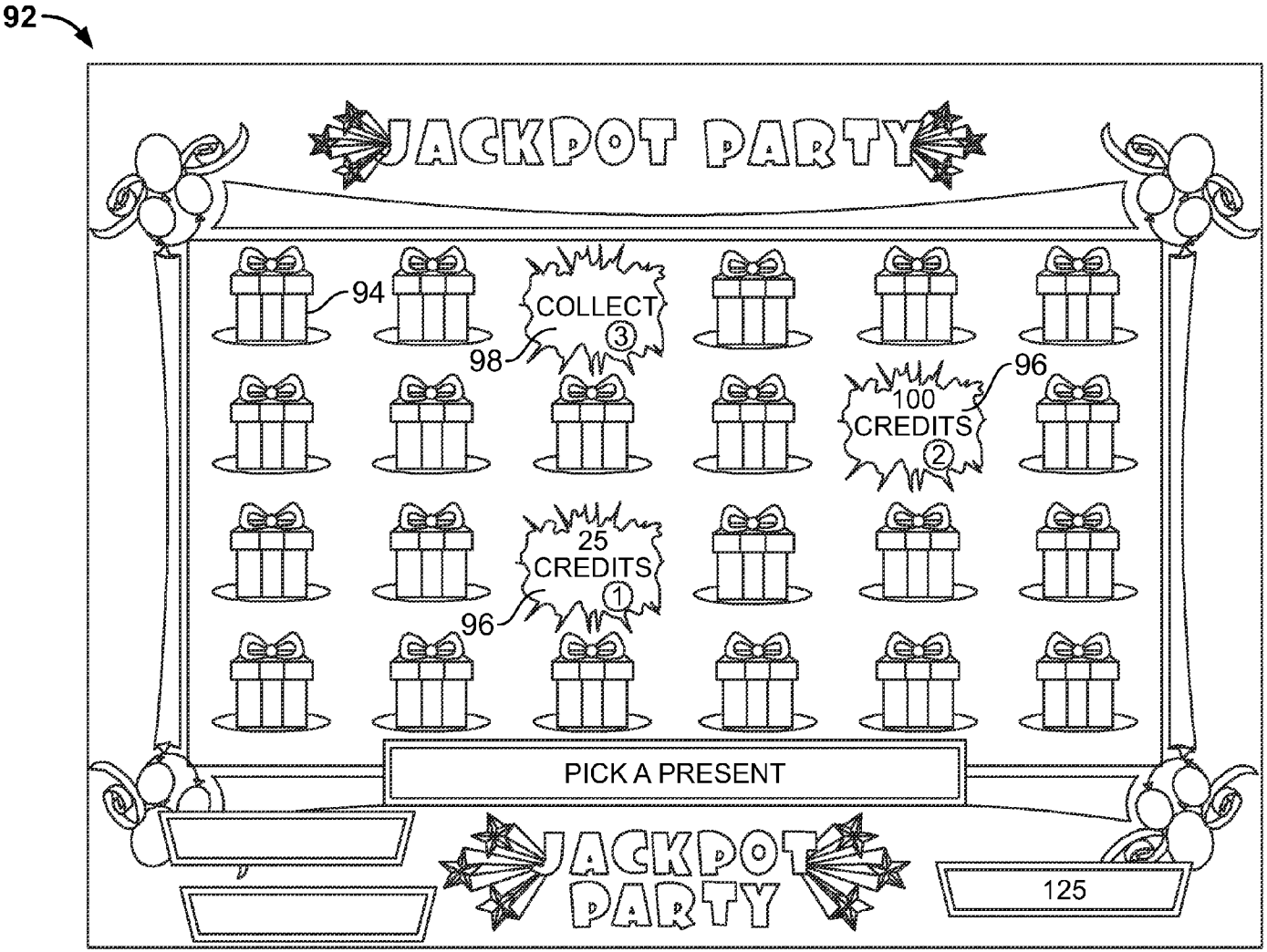
FIG. 4 (Prior Art)
FIG. 4 is a view of a primary display displaying a base game that can be played on the gaming machines according to embodiments of the present disclosure.

Turning now to FIG. 4, a bonus game that may be included with a basic wagering game is illustrated, according to one embodiment. A bonus-game screen 92 includes an array of markers 94 located in a plurality of columns and rows. The bonus game may be entered upon the occurrence of a special start-bonus game outcome (e.g., symbol trigger, mystery trigger, time-based trigger, etc.) in or during the basic wagering game. Alternatively, the illustrated game may be a stand-alone wagering game.

In the illustrated bonus game, a player selects, one at a time, from the array of markers 94 to reveal an associated bonus-game outcome. According to one embodiment, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
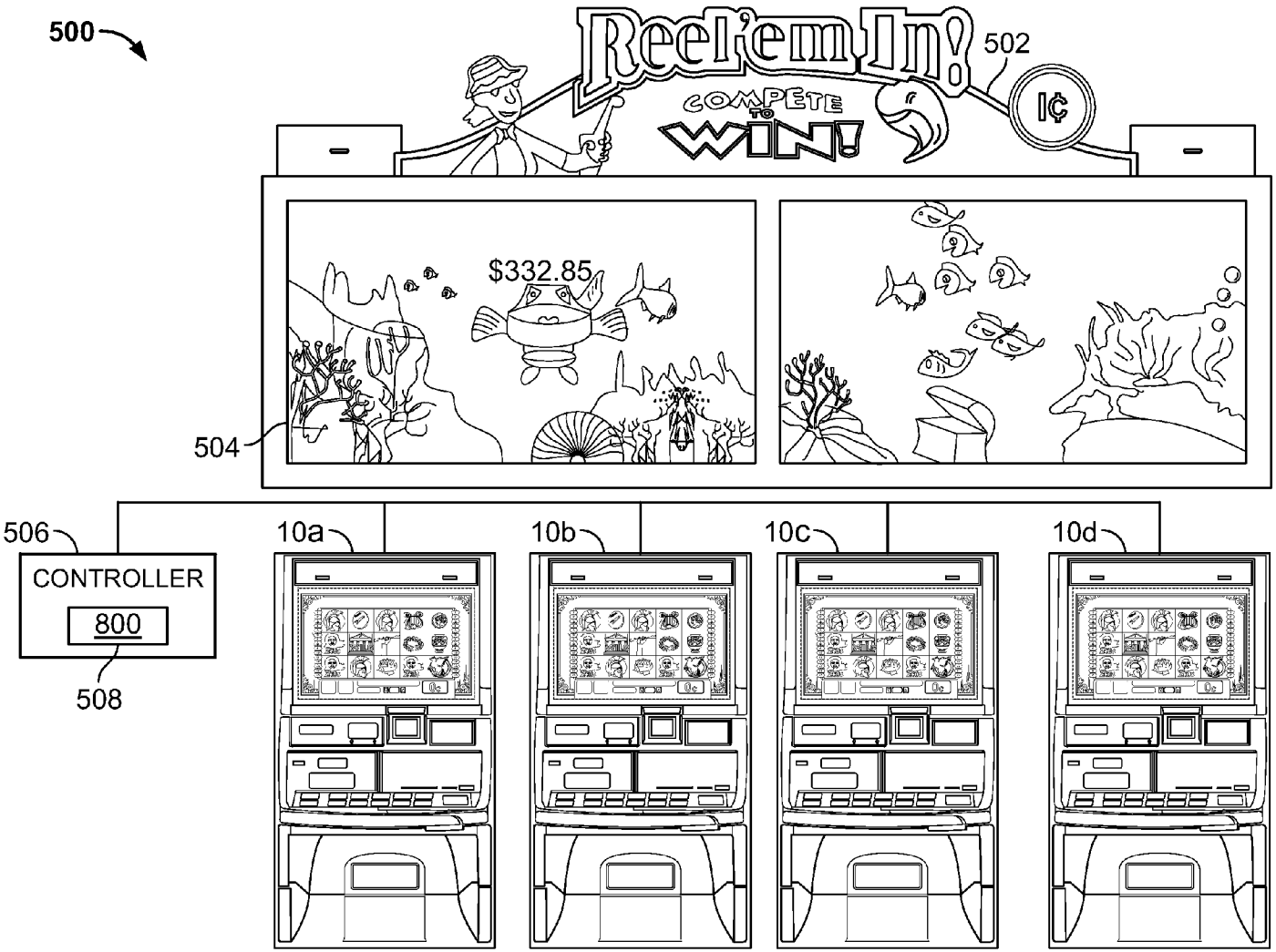
FIG. 5 is a functional block diagram of a network of linked gaming terminals that are coupled to a community display for displaying a community game in response to a triggering event.

While the gaming terminal 10 of FIGS. 1*a*, 1*b* and 2 has been described with respect to a single wagering game providing a base game and a bonus game, the gaming terminal 10 can be connected, or linked, to other gaming terminals 10 via a network for playing a community game. According to an exemplary arrangement depicted in FIG. 5, a gaming system 500 of linked gaming machines 10*a*, 10*b*, 10*c*, 10*d* linked together via a network is shown. The terminals machines 10*a*, 10*b*, 10*c*, 10*d* are of the type described above in connection with FIGS. 1*a*, 1*b* and 2. The gaming terminals 10*a-d* are interconnected and can display the same or different wagering game or games. The gaming terminals 10*a-d* are included under signage 502 that includes a game screen or community display 504 for displaying a community game which, in the configuration depicted in FIG. 5, is based on a REEL'EM IN!® COMPETE TO WIN!™ wagering game available from WMS Gaming, Inc. based in Waukegan, Ill. The community display 504 is situated such that all players at the linked gaming terminals 10*a-d* can view the community display 504. The gaming system 500 can include a controller 506 for assisting in the control of, or completely controlling, a special event. While four linked gaming terminals 10*a-d* are shown in FIG. 5, it is contemplated that more or fewer gaming terminals 10 can be linked together via a network in the gaming system 500 and that the gaming terminals 10 can be geographically remote from each other (e.g., located in different cities). The controller 506 (or the controller 42 or a combination thereof) executes a community-game algorithm 800 that can optionally be stored in a conventional digital memory or storage device 508. The community-game algorithm 800 is described in more detail below in connection with FIG. 8. The storage device 508 that stores the community-game algorithm 800 can be remotely accessible by the controller 42, 506. Likewise, the community-game algorithm 800 can be stored in multiple memory devices, such as the system memory 44, in the external systems 46, or the storage device 508, which are accessed by one or more controllers, such as the controllers 42, 506, or the external systems 46, which can be dispersed about a wagering environment, such as a casino, but networked together via a conventional network.

In the arrangement of FIG. 5, the signage 502 and the controller 506 can be part of the external system 50 in FIG. 2. The controller of the gaming system 500 is coupled to the controller 42 (FIG. 2) of each of the gaming terminals 10*a-d* and the controller 42 transmits information to and receives information from the controller 506. For example, the controller 42 can receive a special-event-triggering signal associated with a special event in response to a special-event outcome that is achieved by at least one of the linked gaming terminals 10*a-d*. The controller 506 transmits a special-event-play signal to the linked gaming terminal 10*a-d*. The special-event-play signal initiates play of a community game, which is displayed on the community display 504.

The community game that is displayed on the community display 504 to players at linked gaming terminals 10*a-d* can include features not available to players playing on non-linked gaming machines. For example, the community game can include a free-spin feature that awards a community free-spin award to all eligible players at linked gaming terminals 10*a-d*. The free-spin feature is randomly selected by the controller 42 or the controller 506 for play in a community game. The conditions or criteria under which a player can become eligible to participate in a community game are discussed in more detail below.

The special-event outcomes that are associated with the community game features can be randomly triggered by the controller 42, 506, which can perform the random selection of the special-event outcome for the linked gaming terminals 10*a-d*. Alternatively, the special-event outcome can be randomly triggered by an outcome at any of the individual gaming terminals 10*a-d* upon achieving, for example, a start-special-event outcome. In yet another alternative, the gaming terminals 10*a-d* only display the special-event outcome (displayed as the community game) such that the gaming terminals 10*a-d* do not have their own separate wagering games (and therefore there is no triggering outcome in a base game).

To explain how the community game features can be employed in a community game, several examples are described in more detail in the following paragraphs. The examples described below refer, in particular, to a community bonus game. However, the following description is not intended to limit the use of the community game features to these particular examples or to a community bonus game as such features can be used in other types of non-bonus wagering games.

In the example shown in FIG. 5, the REEL'EM IN!® COMPETE TO WIN!™ community game is displayed on the signage 502, which is in communication with the linked gaming terminals 10*a-d*. The signage 502 is positioned, in some cases, directly above the linked gaming terminals 10*a-d* such that the community game is viewable by each of the human players at the linked gaming terminals 10*a-d*. In other cases, the signage 502 can be located in a central area such that human players playing at linked gaming terminals 10*a-d* can view the community game from their respective gaming terminals. With any location of the signage 502, it is desirable that other human players who are not participating in the community game get caught up in the excitement of the possibility of winning a community award. The REEL'EM IN!® COMPETE TO WIN!™ community game can include several different features that award different awards, such as credits, free spins, free picks, etc. These awards can be awarded to one or more of the players at the linked gaming terminals 10*a-d* as described in more detail below.

As used herein, the term "proxy player" is a general term that refers to either a human player or a computer-simulated avatar associated with one or more human players. In the case of a human player, a proxy player is indicative of a human player. For example, a text or graphic indicating the corresponding human player can be displayed on a video display (e.g., Player 1, or the human player's name or pseudonym). In the case of a computer-simulated avatar, the proxy player is represented by a computer-simulated avatar associated with one or more human players. In other words, an avatar can be associated with one human player or multiple human players. As used herein, the term "human player" is intended to refer to a proxy player that is indicative of a human player. The term "player" by itself without proxy or human preceding it can refer to either a human player or a proxy player.

As used herein, an award that is accrued is not necessarily an award that is realized by a player. An accrued award can be awarded to the player, meaning that the player receives the value of the accrued award, or an accrued award can not be awarded to the player, in which case the player does not receive the value of the accrued award (i.e., receives nothing). In other words, the noun "award" does not necessarily mean that the player receives or is credited the actual value of the award. The verb "award" and its variants are intended to convey that whatever awards have been accrued by the player are credited to the player's account or meter such that the player receives or is credited with the value of the accrued awards. By contrast, the verb "accrue" and its variants mean that an award has the potential of being awarded to the player if a certain condition or criterion is met. Further, an award can comprise one or more awards of the same or different types. For example, one type of award can be in the form of credits and another type of award can be in the form of a free spin. A player can accrue multiple credits at different stages of a community game, such as 10 credits, then 50 credits, then 100 credits, and each of those three instances of accrued credits represents an award. The total of the accrued credits, i.e., 160, can also represent a single award. Alternately, the player can accrue 50 credits and 2 free spins for a total of three awards. The 50 credits plus 2 free spins can also represent a single award, though comprised of multiple awards (i.e., 50 credits+1 free spin+1 free spin). An award generally is something of value to the player that may or may not be realized by or credited to the player.

The linked gaming terminals 10*a-d* shown in FIG. 5 include individual wagering games displayed on the corresponding primary display 14 or secondary display 16. In some embodiments, each of the individual wagering games displayed at the linked gaming terminals 10*a-d* includes a different theme with a theme-specific bonus. The individual wagering games can be based on any number of themes that may or may not be related to a theme of the community game, such as a reel-fishing game theme shown in FIG. 5. Even though the individual wagering games may differ from one linked gaming terminal 10*a-d* to another, the community display 504 displays the same community game on the gaming terminals 10*a-d* to all of the players at those terminals.

When a community game is triggered by a triggering event, e.g., by a special-event outcome, any player at the linked gaming terminals 10*a-d* can participate in the community bonus game if the player satisfies at least one eligibility criterion to participate in the community game. The triggering event can occur, for example, (a) in response to a randomly generated number falling within a range of preselected numbers or (b) during one of the wagering games conducted at a corresponding one of the linked gaming terminals 10*a,b,c,d*. The eligibility criterion can be based on the quantity of wagers placed by a player at one of the gaming terminals 10*a-d* on any of the wagering games during a predetermined period of time prior to the occurrence of the triggering event. The eligibility criterion can be based on an average wager amount placed by a player at one of the gaming terminals 10*a-d* during a predetermined period of time prior to the occurrence of the triggering event. The eligibility criterion can be based on whether the player achieves a certain status in the wagering game at one of the terminals 10*a,b,c,d* or whether the player has inputted a second wager amount at the gaming terminal 10*a,b,c,d*. Note that participation in the community game is not necessarily conditioned upon receipt of an additional wager.

Eligibility can be based on the amount of time that a player is wagering at the gaming terminal 10*a,b,c,d*. In some examples, a player's eligibility for participating in the community game can change over time. For example, a player may have fifteen seconds for placing a wager on a base wagering game at the gaming terminal 10*a,b,c,d*. If a player does not place a wager in that time period, that player will not be eligible to participate in a community game that is triggered at one of the gaming terminals 10*a-d*. In other implementations having a time-based eligibility feature, a player may be required to play the base wagering game at a certain rate to be eligible for participation in the community game. For example, a counter of bonus-time eligibility can be used to determine whether a player can play the community game once a special event occurs that triggers the community game. This aspect of a wagering game is described in more detail in PCT US2006016536, "Wagering Game With Time-Based Bonus," filed May 1, 2006, by WMS Gaming Inc., which is herein incorporated in its entirety.

Once a community game is triggered, all eligible players at linked gaming terminals 10*a-d* are allowed or authorized to participate in the community game. As discussed above, the community game can include several features that can be randomly triggered or randomly determined (random also refers to pseudo-random herein). These features can award or accrue to a player any of several awards, including credits, free spins such as free spins of reels in a slots wagering game, free picks, multipliers, etc. Some of the features can allow human players to interact with the community game. For example, the community bonus game can include a player input device 24, such as a start/stop button, that allows a player to influence the outcome of the community game by pressing the button and stopping the game to award or accrue a community award (e.g., to activate a free spin). In some configurations, the start/stop button can appear or become highlighted (to indicate that the button is active) on all of the linked gaming terminals 10*a-d* or on selected gaming terminals 10*a-d* based on certain predetermined gaming criteria, outcomes in the base wagering game, or random selection by the controller 42, 506. The player input device 24 can include a video display having a touch screen 28 for receiving input from a human player.

While it has been discussed herein that the controller 506 can control the operation of the community game, it is also possible to have the controller 42 perform these functions. In an implementation, the controller 42 is in one of the gaming terminals 10*a,b,c,d*, and this configuration may be referred to as the "master" and "slave" configuration such that one gaming terminal (i.e., 10*a*) is the "master" that receives the inputs and transmits the information to the other gaming terminals 10*b-d* (i.e., the "slave" gaming terminals).

The community games described herein can be characterized as a "winner-takes-all" competitive game in which proxy players compete (sometimes against one another) to accrue awards via play of the community game, such as the one shown on the community display 504 in FIG. 5. Such community games disclosed herein are said to have a "winner-takes-all" feature. Put simply, the winning proxy player is awarded all of the awards accrued by that proxy player during the community game plus all of the awards accrued by at least the other participating proxy players during the community game.

Referring still to FIG. 5, wagering games are conducted at each of the gaming terminals 10*a-d*, which are communicatively networked together via a network. A triggering event, which can be randomly triggered by a controller, such as the controller 42, or occur during a wagering game conducted at one of the gaming terminals, for example, causes a community game to be initiated. The community game includes at least one round of play during which a winner of the round is identified. When a triggering event occurs, the controller 42, 506 is used to conduct the community game and to cause the community game to be displayed on the community display 506, which can comprise one or more video displays, for example, such as LCD or plasma displays. Participation in the community game is limited to those proxy players who satisfy an eligibility criterion, as described above, and the eligible proxy players compete to accrue as many awards as they can via play of one or more rounds of the community game. A round can end in one example when all of the awards available to be won during the round have been accrued by at least some of the eligible proxy players of the community game. During the round of the community game, at least some of the eligible proxy players accrue awards. Alternately, a round can end when a predetermined number of awards have been accrued to the proxy players of the community game, when a predetermined time period has elapsed, or when a winner of the round is declared.

At the end of the round, if a winning eligible proxy player accrues the highest award (e.g., the award having the most or highest value) among the respective awards accrued by the other proxy players during the round, the winning eligible proxy player is awarded the highest award and at least the respective awards accrued by each of the other eligible proxy players during the round. In some implementations, it is possible that no eligible proxy player accrues the highest award, as detailed further below. Rather, a non-eligible proxy player can accrue the highest award among all the other eligible proxy players, or multiple proxy players can tie for having the same highest award. Note that another example is discussed below in which proxy players accrue awards during multiple rounds, and a winner is determined following the conclusion of a predetermined number of rounds.

Figure 6A:
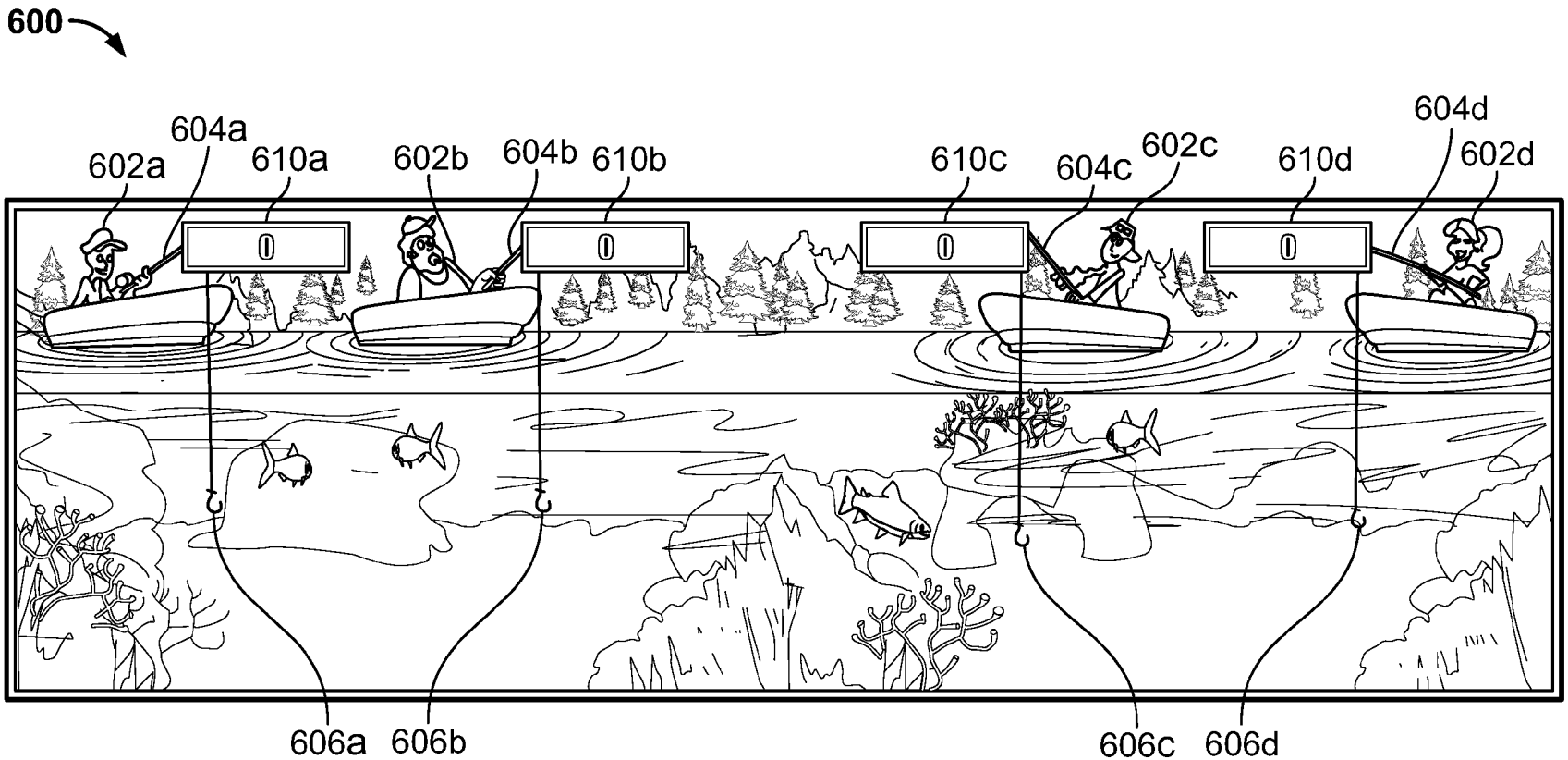
FIGS. 6A-6D illustrate a sequence of graphics depicting a round of a community game that features a "winner-takes-all" feature in which a winning eligible proxy player of the round of the community game is awarded whatever awards the winning eligible proxy player accrued during the round and the awards accrued by the other proxy players during the round.
Figure 6B:
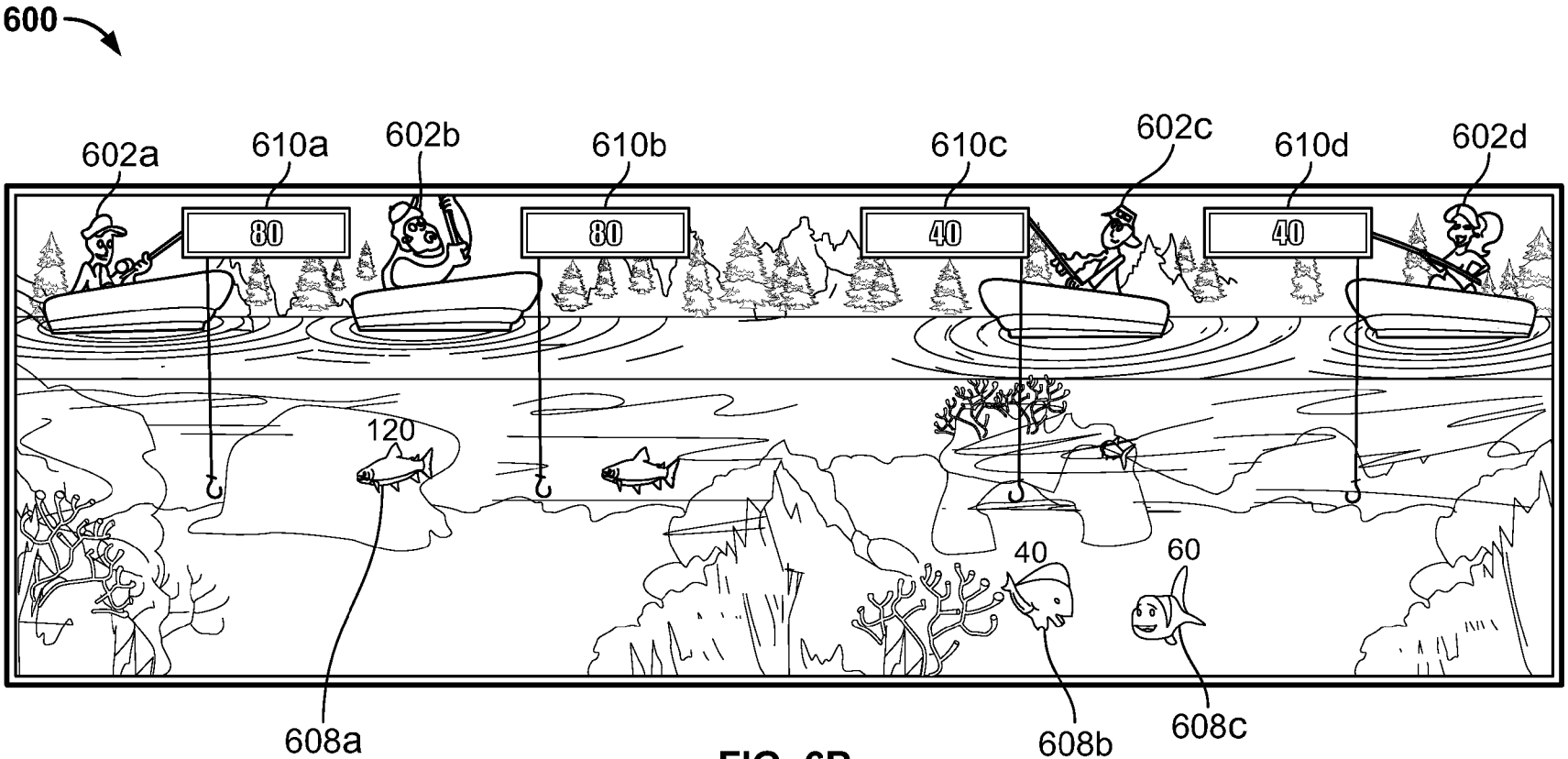
Figure 6C:
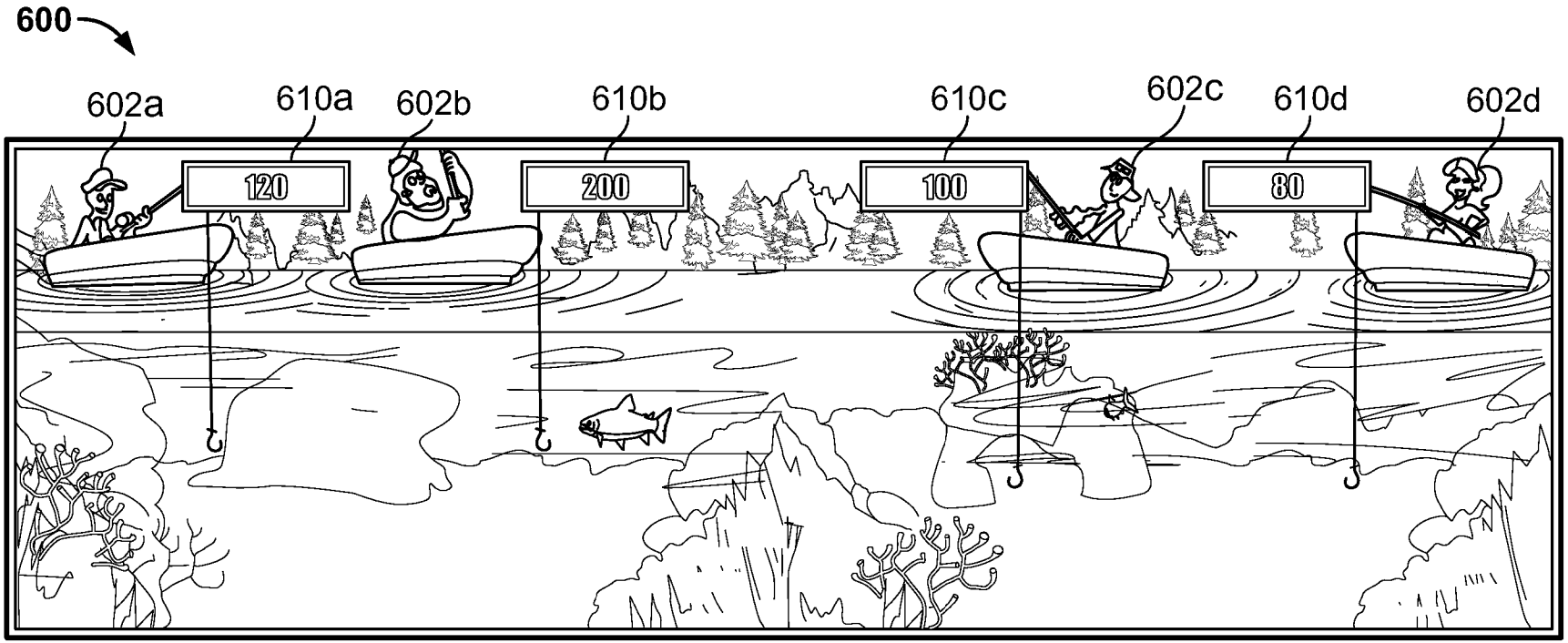

FIGS. 6A-6D illustrate a sequence of graphics depicting a round of a community game 600. In the first graphic shown in FIG. 6A, which shows the start of a round of the community game 600, one or more of the proxy players is associated with one or more virtual (computer-simulated) avatars 602*a,b,c,d* that are each displayed on the community display 504 as a corresponding video graphic. The controller 506, 42 causes each of the virtual avatars 602*a,b,c,d* to appear to interact with video graphics representing the awards that can be won by the proxy players in such a way that a predetermined interaction results in credits being accrued to the proxy player(s) associated with the avatar. In FIG. 6A, the virtual avatars 602*a-d* are represented by fishermen (used generically to refer to men and women fishers), holding fishing reels 604*a,b,c,d* with hooks 606*a,b,c,d*, consistent with the reel-fishing game theme of the community game 600. The awards are represented by corresponding fishes that appear to swim around in the water below the boats in which the avatar fishermen 602*a-d* sit. In FIG. 6B, two such awards are shown as fishes 608*a,b,c* along with the corresponding number of credits (120, 40, and 60, respectively) that can be accrued if they are caught. The credits can be displayed only as the fish draws near to a hook 606*a,b,c,d* to increase anticipation and excitement as the human player observing the interaction does not know how much a fish 608 is worth until it is made to appear to swim close to a hook 606. The predetermined interaction that results in credits being accrued by one of the avatars 602*a,b,c,d* corresponds to one of the fishes 608*a,b* being made to appear to be hooked by one of the hooks 606*a,b,c,d* of the fishing reels 604*a,b,c,d*, thereby causing the credits associated with the award to be accrued by the proxy player(s) associated with the avatar 602*a,b,c,d* who "hooked" the fish. It should be emphasized that more than one player can be associated with the same fisherman 602*a,b,c,d*.

Each fish represents an award of a certain number of credits. Each award has a value selected from a range of credits. The first award to be awarded to a proxy player of the community game has a first value selected from the range of credits. A last of the awards to be awarded has a second value, which is higher than the first value, also selected from the range of credits. The value of each of the awards is based on the value of the highest award. By way of example only, the value of each award, except the last award to be awarded, can range from 20-49130 credits, based on the value of the largest award when the community game is triggered. The value of the last award to be awarded ranges from 100-49130 credits, based on the value of the largest award when the community game is triggered. During each round, each fisherman try to catch, or, alternately, catch a predetermined number of fish, such as 3, 4, or 5.

The community display 504 that displays the community game 600 also displays credit meters 610*a,b,c,d* for each of the proxy players participating in the community game 600. The credit meters 610*a-d* display the number of credits accrued by each of the proxy players during a round of the community game 600. At the beginning of the round shown in FIG. 6A, all of the credit meters 610*a-d* show no credits. As the round of the community event progresses, the awards represented by the fishes 608 are accrued by various of the avatars 602*a-d* associated with corresponding proxy players at the gaming terminals 10*a-d*. Credits accrued by the proxy players during the round are shown in the respective credit meters 610*a-d* so that the human players can track their progress relative to each other. The credit meters 610*a-d* are visible to all of the human players of the community game 600. Thus, the proxy players represented by the avatars 602*a,b* have each accumulated 80 credits in FIG. 6B as shown in their respective credit meters 610*a,b*, and the proxy players represented by the avatars 602*c,d* have each accumulated 40 credits as shown in their respective credit meters 610*c,d*. Additional awards represented by the fishes 608*a,b,c* yet to be won are shown along with their corresponding credit amounts (120, 40, and 60, respectively). As the round continues in FIG. 6C, the proxy player represented by the avatar 602*b* has caught the fish 608*a*, causing an additional 120 credits to be accrued and incrementing that player's credit meter 610*b* from 80 to 200 credits. The other proxy players have also increased their respective credit meters by catching smaller awards worth fewer credits. For example, the proxy player represented by the avatar 602*a* has captured the fish 608*b* that was worth 40 credits, increasing that proxy player's credit meter 610*a* from 80 to 120 credits. Similarly, the proxy player represented by the avatar 602*c* has captured the fish 608*c* that was worth 60 credits, increasing that proxy player's credit meter 610*c* from 40 to 100 credits. At this stage of the round, the proxy player represented by the avatar 602*b* is in the lead with 200 credits. The proxy player represented by the avatar 602*a* is in second place with 120 credits. Although the fishes are represented by credits, in other implementations, the fishes can represent other types of awards, such as multipliers, free spins, free picks, and the like.

Anticipation and excitement can be further enhanced by displaying an indication that a bigger fish than the one hooked by an avatar 602*a,b,c,d* appears to consume the fish hooked by the avatar 602*a,b,c,d*, causing an increase in the value of the award to be accrued by the player associated with the avatar 602*a,b,c,d*. Thus, for example, when the avatar 602*b* associated with a player catches the fish award worth 120 credits, a bigger fish worth 200 credits can gobble up the smaller fish, increasing the award accrued for that proxy player during that stage of the round from 120 credits to 200 credits.

Figure 6D:
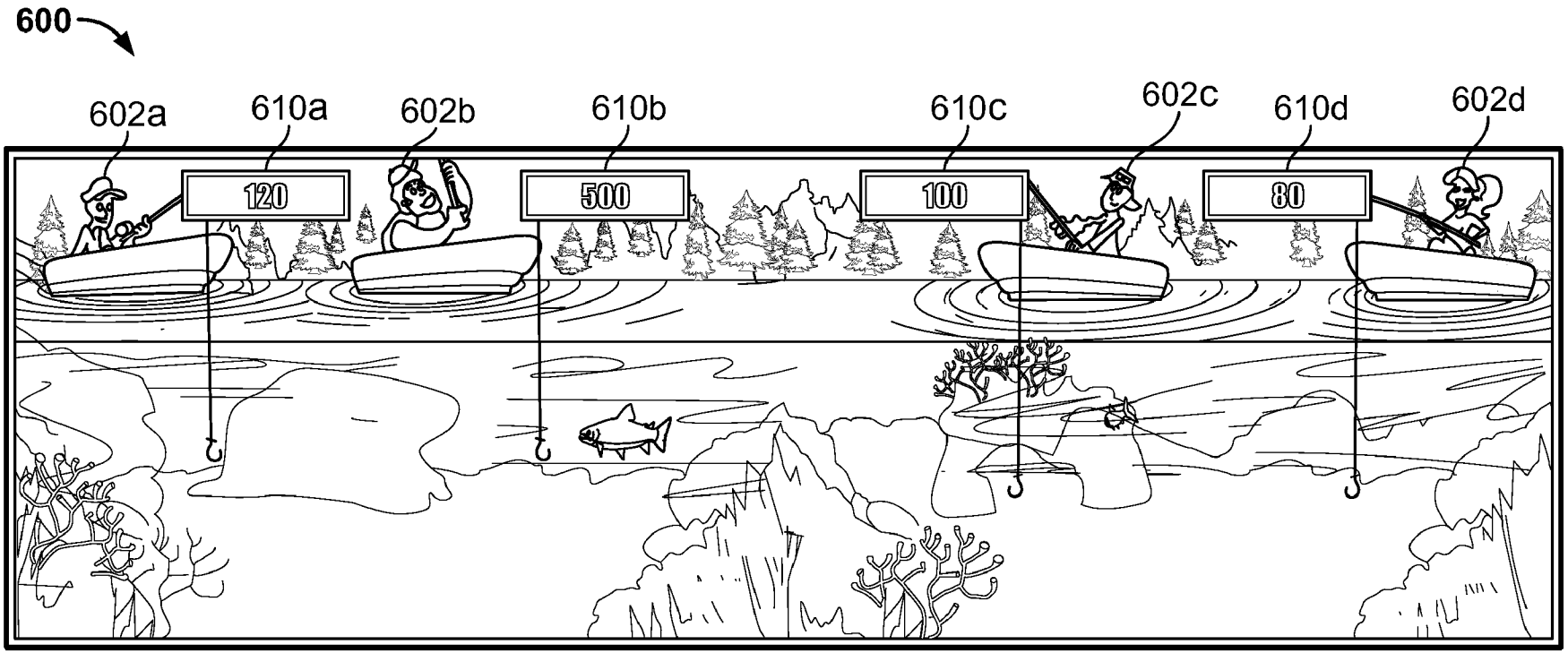

FIG. 6D shows the credit meters 610*a-d* at the end of the round of the community game 600 and how the "winner-takes-all" feature is implemented. Each of the proxy players represented by the avatars 602*a*, 602*c*, and 602*d* is awarded the credits in their respective credit meters 610*a,c,d* at the end of the round of the community game 600. But the proxy player represented by the avatar 602*b* is awarded the credits accrued by that player during the round of the community game 600 (200 credits) plus the sum of the credits accrued by the other proxy players during the round (120+100+80=300 credits+200 credits=500 credits). Thus, the winning player represented by the avatar 602*b* is awarded 500 credits total at the end of the round of the community game 600. The facial expression of the avatar 602*b* is changed from a look of contentment to a look of delight to mirror or provoke an excited emotion in the winning human player. Other visual and/or aural indicia to highlight the winning human player can be portrayed to announce the winning human player and draw attention to that human player. The corresponding gaming terminal 10*b* can light up with lighting effects and/or play enhanced audio to draw attention to the human player at that terminal 10*b*.

It is important to emphasize that the "winner-takes-all" feature is in the context of a community game in which only certain proxy players who satisfy an eligibility criterion can participate while other proxy players who do not satisfy the eligibility criterion cannot participate but can view and observe the community game. Moreover, it is important to note that the eligible proxy players participating in the community game who do not win the highest number of credits during a round can still keep the awards that they accrued during the round, so they do not leave the community game empty-handed. The community game has a competitive aspect to it in that the human players see how many awards each of the other players is accruing, and a sense of excitement and anticipation builds up as the round or rounds progress and as each player accumulates awards. During the round or rounds, each player monitors the other players' award progress to compare how quickly they are accruing awards relative to the other players.

As noted above, it is possible for more than one proxy player to have the same highest number of credits in their respective credit meters 610 at the end of a round. In the event of a tie, for example, if both proxy players have 500 credits but the other proxy players have less than 500 credits, several different community-game award schemes are contemplated. In a first community-game award scheme, the two tied proxy players face off in a tie-breaker round during the community game, and a single tie-breaker award having a certain award is awarded to one of the tied proxy players to break the tie. The winning proxy player having the highest award is awarded that award and the awards accrued by all of the other eligible proxy players during the round. An optional second-place award can be awarded to the non-winning proxy player of the tie-breaker round. For example, the second-place award has a predetermined value or can be based on the awards accrued by the other proxy players. In a second community-game award scheme, both proxy players are awarded the highest award they accrued and the respective other awards accrued by the other eligible proxy players during the round. Thus, two proxy players accrued 200 credits each, and two other proxy players accrued 100 credits each, both of the tied proxy players are awarded 400 credits each (200+100+100). Alternately, both of the tied proxy players can be awarded 600 credits each (200+200 representing the other tied proxy player's credits+100+100).

As mentioned above, it is desirable for the non-eligible proxy players to be able to observe the community game and to display the awards that the non-eligible proxy players would have won had they met the criterion or criteria for participating in the community game. A prominent "not eligible" graphic or similar graphic indicating the non-eligible status of the player can be displayed on one of the human player's screens at the gaming terminal 10 to reinforce and emphasize the fact that this player cannot participate in the community game. To further incentivize the player to meet the eligibility criterion next time, the community game is visible to the human player while the player continues to place wagers on the base or main or primary wagering game at the gaming terminal, and the would-be awards that the player would have won had the player been eligible to participate in the community game are displayed for the player to view with rue and regret. Optionally, the display of the gaming terminal of the non-eligible human player can also display information as to what the non-eligible human player can do to achieve eligible status to participate in the next community game. For example, the display can report that the non-eligible human player could have achieved eligible status by placing three more wagers prior to the occurrence of the triggering event or could have wagered an additional number of credits prior to the occurrence of the triggering event. The display can remind the human player generally of the eligibility criterion or criteria to gain participation rights to the community game.

Figure 7A:
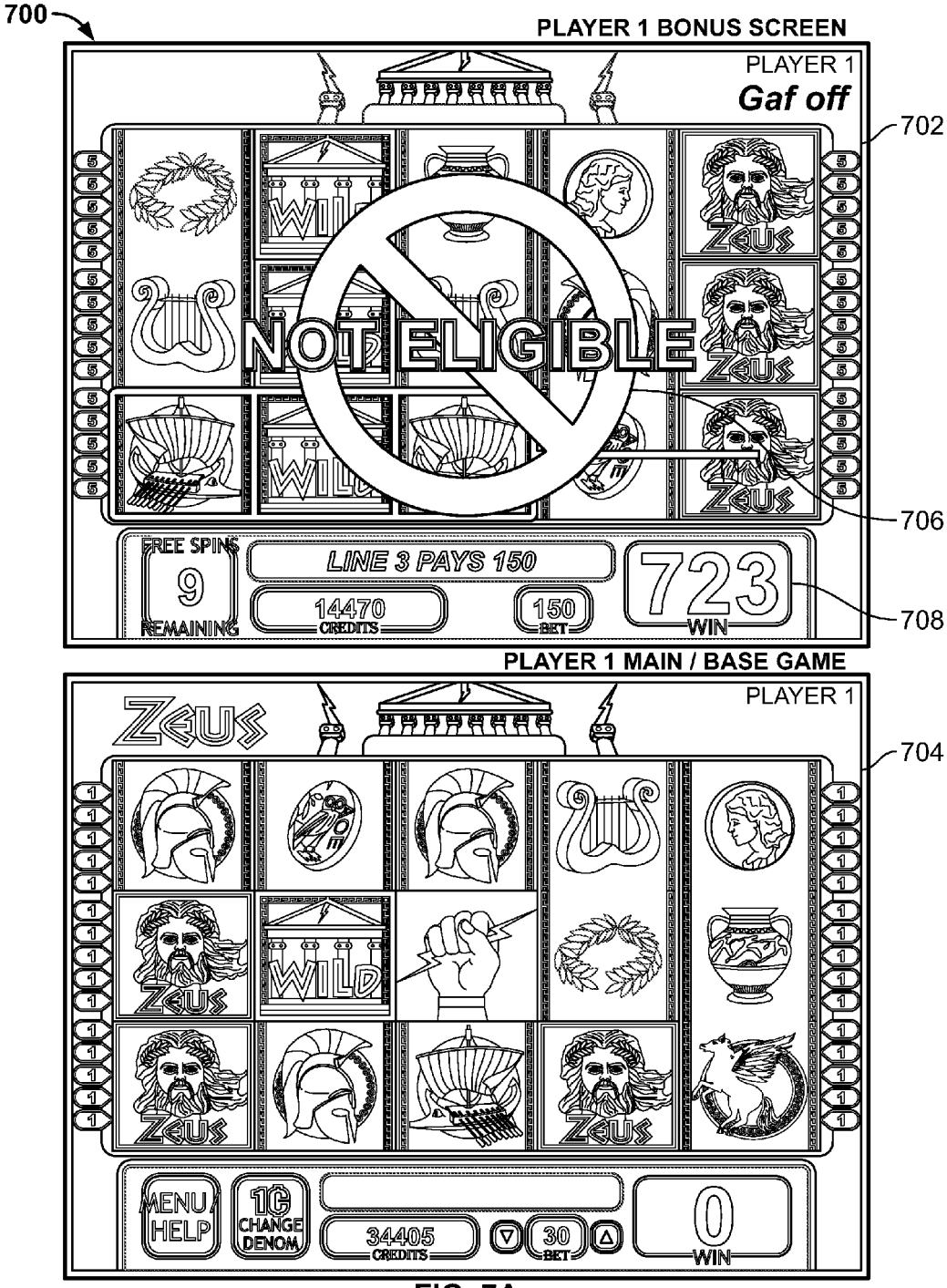
FIG. 7A are exemplary screenshots of a display system having first and second displays, where the first display displays an ongoing community game to a non-eligible proxy player at one of the gaming terminals.

FIG. 7A are exemplary screenshots of a display system 700 having a first display 702 and a second display 704. These displays 702, 704 can correspond to, for example, the primary display area 14 and the secondary display area 16 of the gaming terminal 10. Alternately, the display 702 can correspond to the community display 504. The displays 702, 704 are viewable by a human player at one of the gaming terminals 10*a-d* shown in FIG. 5. In this example, the display 702 prominently features an indicia 706 that indicates that the human player is not eligible to participate in a community game that is underway and being displayed on the community display 504, such as shown in FIG. 5. In the illustrated example, the community game is a reel-based slots wagering game in which one or more free spins are accrued to the proxy players during the community game. The indicia 706 is composed of the words "not eligible" or similar indicia superimposed in front of a circle with a diagonal cross running across its diameter, and participation in the community game is disabled for the non-eligible proxy player in this example. Displayed behind the indicia 706 is a screen displaying to the human player the community game along with the awards via an award meter 708 that the human player would have won had the human player been eligible to participate in the community game. The human player can continue to play the main or base or primary wagering game via the display 704, and might be incentivized to play the wagering game with greater frequency or to insert higher wagers in an attempt to qualify for eligibility to participate in the next community game. By watching the would-be awards accumulate in the meter 708 on the display 702, the human player feels left out of the action and is potentially forgoing significant awards, creating an incentive for the human player to satisfy the eligibility criterion for participation in the community game.

Figure 7B:
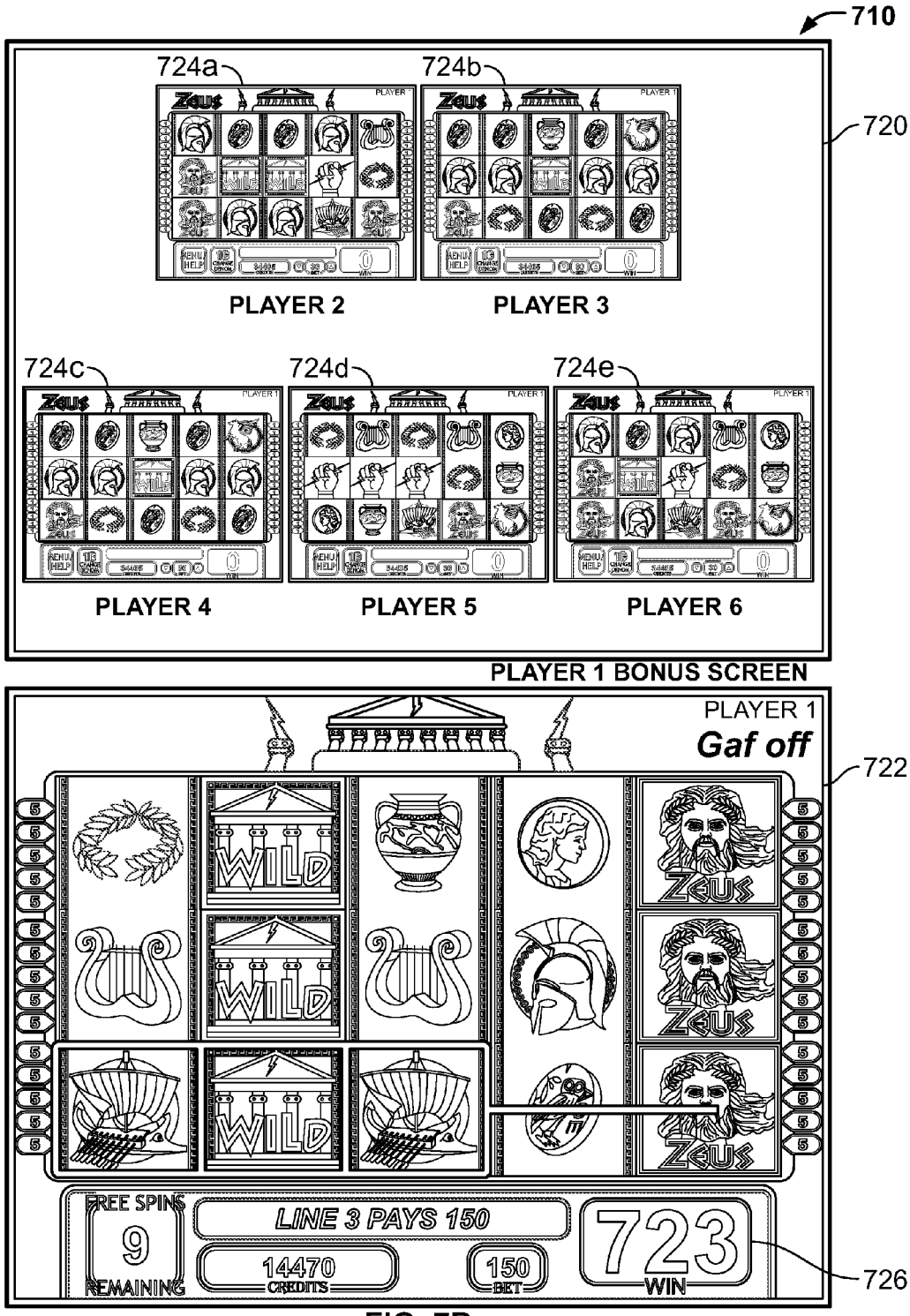
FIG. 7B are exemplary screenshots of a display system having first and second displays, where the first display displays an ongoing community game to an eligible proxy player along with reduced images of the displays of the other eligible proxy players who are participating in the community game.

By contrast, in FIG. 7B, two displays 720, 722 are shown for a human player who did satisfy the eligibility criterion to participate in a community game 710, such as a reel-based slots wagering game. On the first display 720, the human player is shown reduced images (akin to thumbnail images sized for viewing by the human player) of the corresponding displays 724*a,b,c,d,e* of the other eligible proxy players who are participating in the community game. In this example, there are a total of six proxy players participating in the community game, which corresponds to a video reel game. The community game, common to all six proxy players, is displayed on the display 722 along with a meter 726 showing the awards accrued by that proxy player during the round of the community game.

The next few examples illustrate how winning eligible proxy players receive the other proxy players' accumulated awards while non-eligible proxy players receive nothing, though they are shown the awards that they would have received had they been eligible to participate in the community game. Each proxy player plays their own independent free-spin round to determine that proxy player's award during the free-spin round. For example, as shown in FIG. 7B, the screens 722, 724*a-e* display six different randomly selected outcomes of the free-spin rounds for each of the respective proxy players 1-6. It should be noted that these examples assume a free-spin bonus round of the community game in which no additional wager is required by the player to participate in the community game. However, in other implementations, an additional wager can be required of the player to be credited a certain number of spins for participation in the community game. The general term "community-game spin" refers to both a free-spin in which no additional wager is required and a spin in which an additional wager is required as a precondition for participation in the community game, including satisfying at least one other eligibility criterion. At the conclusion of each community-game spin, a randomly selected outcome for that spin is determined and a number of credits (including zero credits) is accrued to the proxy player (such as via the credit meter associated with the player).

In a first exemplary round of a community game, the final credits are distributed as follows at the end of the first round:

| Proxy Player | Status | Credits Accumulated During Round 1 | Total Award Received by Player |
|---|---|---|---|
| Player 1 | Eligible | 45 | 67 or 92 |
| Player 2 | Eligible | 22 | 22 |
| Player 3 | Not Eligible | 10 | 0 |
| Player 4 | Eligible | 0 | 0 |
| Player 5 | Not Eligible | 15 | 0 |
| Player 6 | Eligible | 0 | 0 |

Proxy Player 1 is the winner of the first round, having accrued the highest award (number of credits in this example) during the round, and is thus awarded Proxy Player 1's accrued awards (45 credits) and all of the other proxy players' awards, including those accrued by the non-eligible proxy players (92 credits=45+22+10+15), or the sum of only those awards accrued by the other non-winning eligible proxy players (67 credits=45+22 only). The non-eligible proxy players are not awarded any award they may have accrued during the round, and the eligible proxy players are awarded whatever awards they accrued during the round. Alternately, Proxy Player 1 can be awarded only those awards accrued by other eligible proxy players and cannot be awarded awards accrued by non-eligible proxy players. Thus, in this scenario, Proxy Player 1 would be awarded an award of 67 credits instead of an award of 92 credits.

Round 2 unfolds as follows:

| Proxy Player | Status | Credits Accumulated During Round 2 | Total Award Received by Player |
|---|---|---|---|
| Player 1 | Eligible | 25 | 25 |
| Player 2 | Eligible | 60 | 60 |
| Player 3 | Not Eligible | 25 | 0 |
| Player 4 | Eligible | 125 | 265 or 290 |
| Player 5 | Not Eligible | 0 | 0 |
| Player 6 | Eligible | 55 | 55 |

Proxy Player 4 is the winner of the second round, having accrued the highest award (number of credits in this example) during this round, and is thus awarded Proxy Player 4's accrued awards (125 credits) and the all of the other proxy players' awards, including those accrued by the non-eligible proxy players (290 credits=125+25+60+25+55), or only those accrued by the other non-winning eligible proxy players (265 credits=25+60+125+55). Again, the non-eligible proxy players are not awarded any of the awards they accrued during the round, and the non-winning eligible proxy players are awarded whatever awards they accrued during the round. Alternately, Proxy Player 4 can be awarded only those awards accrued by other eligible proxy players and cannot be awarded awards accrued by non-eligible proxy players. Thus, in this scenario, Proxy Player 4 would be awarded an award in the form of 265 (25+60+125+55) credits instead of 290 credits. The 25 credits accrued by non-eligible Proxy Player 3 would not be added to Proxy Player 4's total award.

Round 3 unfolds as follows, with no eligible proxy player accruing the highest number of credits:

| Proxy Player | Status | Credits Accumulated During Round 3 | Total Award Received by Player |
|---|---|---|---|
| Player 1 | Eligible | 0 | 0 |
| Player 2 | Eligible | 100 | 100 |
| Player 3 | Not Eligible | 125 | 0 |
| Player 4 | Eligible | 10 | 0 |
| Player 5 | Not Eligible | 15 | 0 |
| Player 6 | Eligible | 5 | 5 |

In this example, Proxy Player 3, who is not an eligible proxy player and did not participate in the community game, accrued the highest award during this third round. Unfortunately, because Proxy Player 3 is non-eligible, no eligible proxy player is awarded any awards accrued by the other eligible proxy players. Proxy Players 2 and 6 are still awarded whatever awards they accrued during the round, respectively, but no more. The human player associated with Proxy Player 3, being a non-eligible proxy player, is able to see that he would have been declared the winner of this round, and thus would have been eligible to win not only an award worth 125 credits, but an additional 125 credits accrued by the other proxy players. But, because Proxy Player 3 is non-eligible, Proxy Player 3 is awarded nothing. After this result, the human player associated with Proxy Player 3 may receive dirty looks and scornful glares from the other human players, increasing the incentive and pressure for Player 3 to satisfy the eligibility criterion for participation in the next community game.

In the above three examples, three different and exemplary free-spin rounds are featured, with a winner declared after each free spin. In other words, each round ends after one free spin, and awards for eligible proxy players participating in the round are determined on a spin-by-spin basis. Alternately, a winner can be declared after multiple free spins (for example, after 3 or 5 free spins), with the accumulated credits tallied up at the conclusion of the multiple free-spins and the winning eligible proxy player determined based on the total credits accrued at the conclusion of the multiple free spins. In this example, suppose there are three rounds in the community game, and they result in the awards schedule identified in the three tables above. Instead of a winner being declared after each free-spin round, each proxy player continues to accrue credits until the conclusion of the third round of the community game. Thus, at the conclusion of all three rounds, the proxy players have the following credit totals:

| Proxy Player | Status | Credits Accumulated After all 3 Rounds | Total Award Received by Player After All 3 Rounds |
|---|---|---|---|
| Player 1 | Eligible | 70 | 70 |
| Player 2 | Eligible | 182 | 447 or 637 |
| Player 3 | Not Eligible | 160 | 0 |
| Player 4 | Eligible | 135 | 135 |
| Player 5 | Not Eligible | 30 | 0 |
| Player 6 | Eligible | 60 | 60 |

Thus, at the end of the three rounds, Proxy Player 2 has accrued the highest award (182 credits) among the other proxy players. Proxy Player 2's final "winner-takes all" award can be either worth 447 credits, when it includes only those credits accrued by the non-winning eligible Proxy Players 1, 4, and 6 (along with Proxy Player 2's accrued credits during all three rounds), or worth 637 credits when Proxy Player 2's total award further includes the credits accrued by non-eligible Proxy Players 3 and 5 during all three rounds.

Any of the examples herein can award a second-place award to an eligible proxy player who accrues the second highest award (e.g., number of credits) during a round of the community game. The second-place proxy player can be awarded the award accrued by that proxy player and at least the awards accrued by the other eligible proxy players except for the winning proxy player's award. Thus, using the second round results in the table above, Proxy Player 2 is the runner-up, having accrued the second highest award (worth 60 credits) during the round. In this example, Proxy Player 2 would be awarded an award of 60 credits plus an additional 105 credits (25 credits from Proxy Player 1, 25 credits from Proxy Player 3, and 55 credits from Proxy Player 6) for a total of 165 credits. Alternately, Proxy Player 2 would be awarded an award of 60 credits plus an additional 80 credits from eligible Proxy Players 1 and 6 only (and not from non-eligible Proxy Player 3), for a total award of 140 credits.

In any of the examples herein, if an eligible proxy player entered the community game with a multiplier achieved one of the wagering games played on the terminals 10*a-d*, the winning eligible proxy player's total award achieved during the round can be further multiplied by the multiplier. One or more of the other eligible proxy players' total awards can also be multiplied by the multiplier achieved during the wagering game that triggered the community event.

Figure 8:
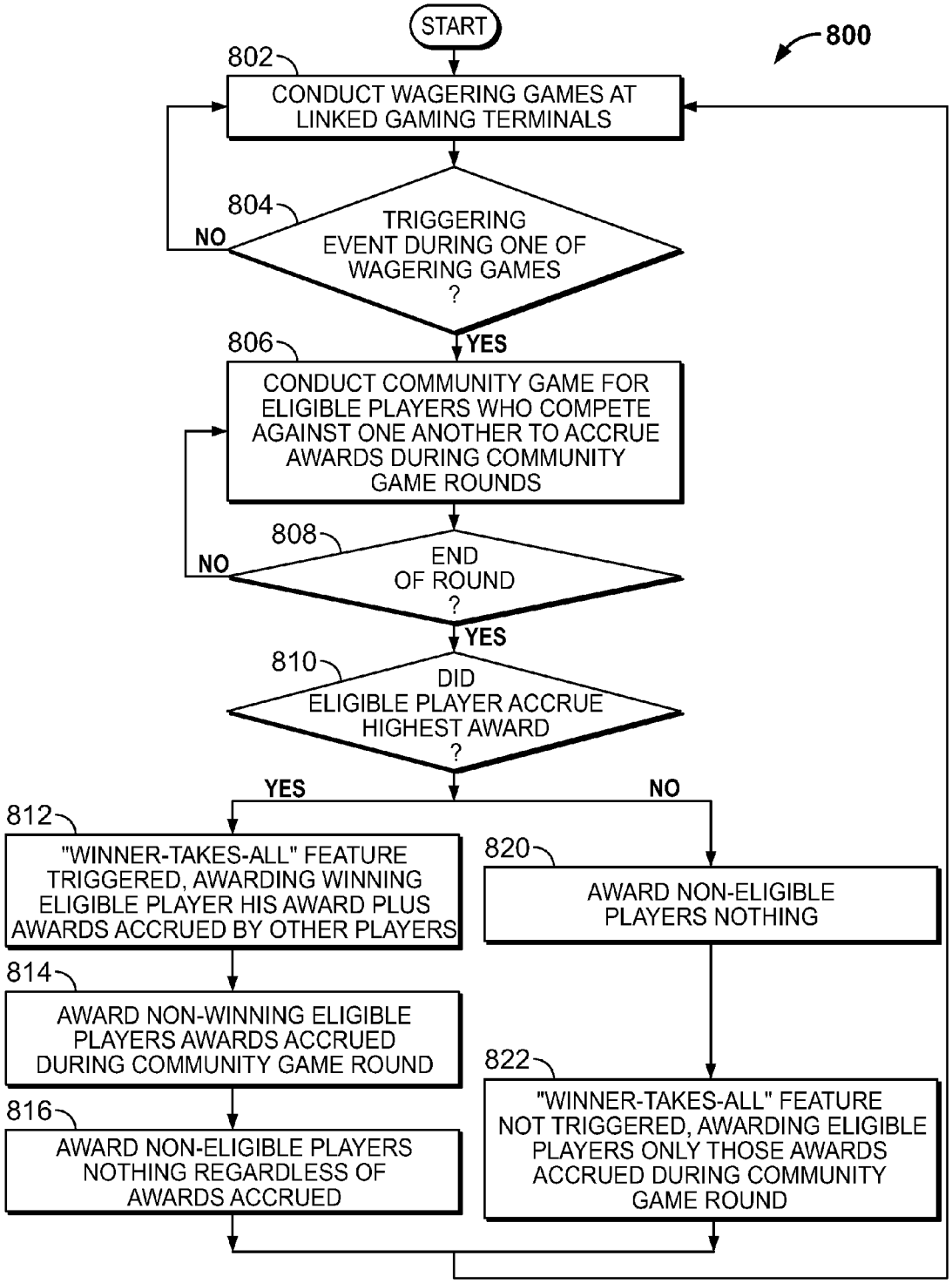
FIG. 8 is a flowchart for a community-game algorithm that corresponds to instructions executed by a controller in accord with at least some aspects of the disclosed concepts.

FIG. 8, described by way of example above, represents one exemplary community-game algorithm 800 that corresponds to at least some of the instructions executed by the controller 42, 506, and/or external systems 46 in FIG. 2 to perform the above-described functions associated with the disclosed concepts. The community-game algorithm 800 is an algorithm for conducting a community game in which proxy players compete against one another to accrue awards via play of the community game. Because there are only so many awards available to be accrued during a round of the community game, the proxy players hope to accrue as many awards as possible to trigger a winner-takes-all feature in which the qualifying winner of the round is awarded the awards accrued by all of the other proxy players in addition to the awards accrued by the winner during the round. To qualify as a winner, a proxy player must have at least satisfied an eligibility criterion to participate in the community game. The algorithm 800 conducts wagering games at the gaming terminals, such as the gaming terminals 10*a-d*, networked together via a network (802). A triggering event causes a community game to be initiated. The community game includes at least one round of play during which a winner of the round is identified.

The algorithm 800 determines whether a triggering event occurred during one of the wagering games (804). If not, the algorithm 800 continues to conduct the wagering games (802) until a triggering event occurs in one of the wagering games. Examples of triggering events have been provided above. If a triggering event has occurred during one of the wagering games, the algorithm 800 conducts the community game, such as the community game 600, using a controller, such as the controller 42, 506, and causes the community game to be displayed on a display, such as the community display 504 (806). Each of the eligible proxy players of the community game who satisfy an eligibility criterion to participate in the community game compete (sometimes against one another) to accrue credits via play of one or more rounds of the community game (806).

The algorithm 800 determines whether an end of the round has occurred (808). If not, the algorithm 800 continues to conduct the community game using the controller. If so, the algorithm determines whether an eligible proxy player accrued the highest award (such as in the form of a number of credits) among the respective awards accrued by the other proxy players of the community game (810). The "other proxy players" can include eligible and non-eligible proxy players or, alternately, eligible proxy players only. If an eligible proxy player has accrued the most awards of all the other proxy players during the round, a "winner-takes-all" feature is triggered, in which the winning eligible proxy player is awarded whatever awards the proxy player accrued during the round and at least the respective awards accrued by the other proxy players during the round (812). Again, "other proxy players" can refer to eligible and non-eligible proxy players or, alternately, eligible proxy players only. The algorithm 800 awards the non-winning eligible proxy players whatever awards each of the non-winning eligible proxy players accrued during the round (814). In this example, none of the eligible proxy players who accrued awards during the round walks away empty-handed. The non-eligible proxy players are awarded nothing, regardless of whether they accrued any awards during the round (816). In other words, non-eligible proxy players can accrue awards during the round just like eligible proxy players can, but at the end of the round, the non-eligible proxy players are not awarded any of those accrued awards.

Note that if more than one eligible proxy player accrued the highest award during the round (810), such that a tie occurs and no one winner can be declared, the algorithm 800 can optionally award both proxy players an award according to a winner-takes-all feature or can invoke a tie-breaker round in which the tie is broken and a single winner is declared and awarded the winner-takes-all credits. These tie-breaker scenarios are disclosed above.

If an eligible proxy player did not accrue the most credits during the round, the algorithm 800 awards the non-eligible proxy players nothing (820) and does not trigger the winner-takes-all feature (822). The algorithm 800 awards the non-winning eligible proxy players only those awards they accrued during the round (822). In this scenario, no proxy player is awarded a winner-takes-all award comprising awards accrued by other proxy players. Each eligible proxy player walks away with only those awards the respective proxy player accrued during the round.

The algorithm 800 or any other algorithm disclosed herein corresponds to specially programmed instructions executed by a general purpose controller, such as one or both of the controller 42, 506, for example. The structure(s) corresponding to the functions or acts carried out or performed by the algorithm 800 or any other algorithm disclosed herein is/are the controller 42, the controller 506, or the external systems 46, or any combination thereof, specially programmed for carrying out or performing the specified functions or acts. It is emphasized that any of the functions or acts for implementing any of the algorithms disclosed herein can be carried out or performed by more than one general purpose controller or computer.

It should be noted that the algorithm 800 and other algorithms illustrated and discussed herein as having various modules which perform particular functions and interact with one another. It should be understood that these modules are merely segregated based on their function for the sake of description and represent computer hardware and/or executable software code which is stored on a computer-readable medium for execution on appropriate computing hardware.

The various functions of the different modules and units can be combined or segregated as hardware and/or software stored on a computer-readable medium as above as modules in any manner, and can be used separately or in combination.

While particular embodiments and applications of the present disclosure have been illustrated and described, it is to be understood that this disclosure is not limited to the precise construction and compositions disclosed herein and that various modifications, changes, and variations can be apparent from the foregoing descriptions without departing from the spirit and scope of the invention as defined in the appended claims.

What is claimed is:

1. A method of conducting a community game in which a plurality of players compete to accrue awards via play of the community game, comprising:

conducting wagering games at respective ones of a plurality of linked gaming terminals networked together via a network, the community game including at least one round of play during which a winner of the round is identified;

in response to an occurrence of a triggering event, using a controller to conduct the community game and cause the community game to be displayed on a display, wherein each of a plurality of eligible players of the community game which satisfy an eligibility criterion to participate in the community game compete to accrue awards via play of one or more rounds of the community game;

during a round of the community game, at least some of the eligible players of the community game accruing respective awards;

at the end of the round, responsive to at least a winning one of the eligible players accruing the highest award among the respective awards accrued by the other players, awarding, to the winning eligible player, the highest award and at least the respective awards accrued by the other eligible players; and awarding to each of the non-winning eligible players the respective awards accrued by that non-winning eligible player during the round.

2. The method of claim 1, wherein the awards include awards available to be won during the round, and wherein the round ends responsive to all of the awards available to be won during the round being accrued by at least the eligible players of the community game.

3. The method of claim 1, wherein each of the players is represented by a computer-simulated avatar associated with one or more human players of the community game, the method further comprising:

displaying each of the computer-simulated avatars representing each of the players on the display as a corresponding graphic; and causing each of the avatars to appear to interact with respective graphics representing the awards in such a way that a predetermined interaction results in accrual during the round of at least one of the awards to the player represented by the corresponding avatar.

4. The method of claim 3, wherein at least one of the avatars is associated with at least two of the plurality of players, and wherein the awarding includes, in the event of a tie wherein a second winning one of the eligible players also accrues the same highest award as the first winning player, awarding to each of the two winning eligible players the highest award and at least the respective awards accrued by the other eligible players during the round.

5. The method of claim 1, further comprising:

accruing an award during the round to at least one non-eligible player which did not satisfy the eligibility criterion, wherein the award awarded to the winning eligible player further includes the award accrued by the non-eligible player, and wherein the non-eligible player is not awarded the award accrued during the round.

6. The method of claim 1, further comprising:

accruing an award during the round to at least one non-eligible player who did not satisfy the eligibility criterion;

responsive to the non-eligible player accruing the highest award during the round relative to the respective awards accrued by the other players of the community game, awarding to each of the eligible players only the respective awards accrued by each player during the round; and displaying an indication of the non-eligible player who accrued the highest award the highest award accrued by the non-eligible player, wherein the non-eligible player is not awarded any of the awards accrued during the round.

7. The method of claim 1, wherein each of the players is indicative of a corresponding human player, wherein the eligibility criterion is based on at least the quantity of wagers placed by one of the human players on any of the wagering games during a predetermined time period prior to the occurrence of the triggering event.

8. The method of claim 1, wherein the eligibility criterion is based on at least an average wager amount placed by a human player on any of the wagering games during a predetermined time period prior to the occurrence of the triggering event.

9. The method of claim 1, wherein the triggering event occurs in response to a randomly generated number falling within a range of preselected numbers or during one of the wagering games conducted at a corresponding one of the gaming terminals.

10. The method of claim 1, further comprising awarding to the player of the round who accrued the second highest award among the respective awards accrued by the other players during the round, the second highest award and the at least the respective awards accrued by the other eligible players except for the player who accrued the highest award during the round.

11. The method of claim 1, wherein a multiplier is associated with at least one of the players upon the occurrence of the triggering event, and wherein the award of the at least one player during the round is multiplied by the multiplier.

12. The method of claim 1, wherein the players participate in the community game without requiring any additional wager as a precondition to participating in the community game.

13. The method of claim 1, further comprising:

responsive to more than one player of the players accruing the same highest award at the end of the round, conducting a tie-breaker round during which a tie-breaker award is awarded to a winning one of the players who accrued the same highest award.

14. The method of claim 13, further comprising awarding to at least one of the non-winning players who accrued the same highest award but did not win the tie-breaker award a second-place award having a predetermined value in addition to the award awarded to the at least one non-winning player during the round.

15. The method of claim 1, wherein the round includes one or more free spins by at least the eligible players of the community game, wherein each of the one or more free spins results in an award being accrued to the player.

16. The method of claim 1, wherein the awarding includes awarding to the winning eligible player prior awards accrued to the winning eligible player during at least one earlier round prior to the round.

17. The method of claim 16, wherein the award awarded to the winning eligible player further includes the respective awards accrued by the other eligible players during the at least one earlier round.

18. The method of claim 1, wherein each of the players is indicative of a corresponding human player, wherein each of the wagering games includes a game sequence in which the human player provides an input and a wagering game outcome is determined, and wherein the conducting the wagering games includes:

using a user interface device to accept the player input, and transforming the player input to a corresponding electronic data signal indicative of a wager to play the wagering game;

using one or more processors to interpret the wager from the data signal and to cause the recording of a digital representation of the wager in one or more storage devices;

using at least one of the processors to initiate the game sequence of the wagering game on the networked gaming terminal;

using at least one of the processors to cause at least one display device of the gaming terminal to display a representation of the game sequence; and determining an outcome of the game sequence.

19. One or more non-transitory computer-readable storage media encoded with instructions for directing a gaming system to perform a method of conducting a community game in which a plurality of players attempt to accrue awards via play of the community game, comprising:

conducting wagering games at respective ones of a plurality of linked gaming terminals networked together via a network, the community game including at least one round of play during which a winner of the round is identified;

in response to an occurrence of the triggering event, using a controller to conduct the community game and cause the community game to be displayed on a display, wherein each of a plurality of eligible players of the community game who satisfy an eligibility criterion to participate in the community game compete to accrue credits via play of one or more rounds of the community game;

during a round of the community game, at least some of the eligible players of the community game accruing respective awards;

at the end of the round, responsive to at least a winning one of the eligible players accruing the highest award among the respective awards accrued by the other players during the round, awarding, to the winning eligible player, the highest award and at least the respective awards accrued by the other eligible players during the round, and awarding to each of the non-winning eligible players the respective awards accrued by that non-winning eligible player during the round.

20. The computer-readable storage media of claim 19, further encoded with instructions for directing the gaming system to perform a method that further includes accruing an award during the round to at least one non-eligible player who did not satisfy the eligibility criterion, wherein the award awarded to the winning eligible player includes at least the award accrued by the non-eligible player.

21. The computer-readable storage media of claim 19, further encoded with instructions for directing the gaming system to perform a method that further includes:

accruing an award during the round to at least one non-eligible player who did not satisfy the eligibility criterion;

responsive to the non-eligible player accruing the highest award during the round, awarding to each of the eligible players the respective awards only accrued by each player during the round; and displaying an indication of the non-eligible player who accrued the highest award the highest award accrued by the non-eligible player, wherein the non-eligible player is not awarded any awards accrued by the non-eligible player during the round.

22. The computer-readable storage media of claim 19, further encoded with instructions for directing the gaming system to perform a method that further includes awarding to each of the non-winning eligible players the respective awards accrued by that non-winning eligible player during the round.

23. The computer-readable storage media of claim 19, wherein each of the players is indicative of a corresponding human player.

24. The computer-readable storage media of claim 19, wherein each of the players is represented by a computer-simulated avatar associated with one or more human players.

25. A gaming system for conducting a community game in which a plurality of players attempt to accrue awards via play of the community game, comprising:

means for conducting wagering games at respective ones of a plurality of linked gaming terminals networked together via a network, the community game including at least one round of play during which a winner of the round is identified;

means for conducting the community game and for causing the community game to be displayed on a display in response to an occurrence of the triggering event, wherein each of a plurality of eligible players of the community game who satisfy an eligibility criterion to participate in the community game compete to accrue awards via play of one or more rounds of the community game;

means for accruing awards by at least some of the eligible players of the community game during a round of the community game;

means, responsive to at least a winning one of the eligible players accruing the highest award among the respective awards accrued by the other players during the round, for awarding, to the winning eligible player at the end of the round, the highest award and at least the respective awards accrued by the other eligible players during the round and for awarding to each of the non-winning eligible players the respective awards accrued by that non-winning eligible player during the round.

26. The gaming system of claim 25, further comprising means for accruing an award during the round to at least one non-eligible player who did not satisfy the eligibility criterion, wherein the award awarded to the winning eligible player includes the award accrued by the non-eligible player, and wherein the non-eligible player is not awarded any awards accrued by the non-eligible player during the round.

27. The gaming system of claim 25, further comprising:

means for accruing an award during the round to at least one non-eligible player who did not satisfy the eligibility criterion;

means for, responsive to the non-eligible player accruing the highest award during the round, awarding to each of the eligible players the respective awards only accrued by each player during the round; and means for displaying an indication of, to the non-eligible player who accrued the highest award, the highest award, wherein the non-eligible player is not awarded any awards accrued by the non-eligible player during the round.

* * * * *